US010927517B2

(12) United States Patent
Fulbrook

(10) Patent No.: US 10,927,517 B2
(45) **Date of Patent: *Feb. 23, 2021**

(54) SCOOPER ASSEMBLY

(71) Applicant: Jim E Fulbrook, Fairfax, VA (US)

(72) Inventor: Jim E Fulbrook, Fairfax, VA (US)

(73) Assignee: Efficiency Products, LLC, Fairfax, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/806,352

(22) Filed: Mar. 2, 2020

(65) Prior Publication Data

US 2020/0199835 A1 Jun. 25, 2020

Related U.S. Application Data

(63) Continuation of application No. 16/514,005, filed on Jul. 17, 2019, now Pat. No. 10,577,765, which is a continuation-in-part of application No. PCT/US2018/015549, filed on Jan. 26, 2018.

(60) Provisional application No. 62/451,268, filed on Jan. 27, 2017.

(51) Int. Cl.
*E01H 1/12* (2006.01)

(52) U.S. Cl.
CPC ..... *E01H 1/1206* (2013.01); *E01H 2001/128* (2013.01); *E01H 2001/1266* (2013.01); *E01H 2001/1286* (2013.01); *E01H 2001/1293* (2013.01)

(58) Field of Classification Search
CPC ..... E01H 1/1206; E01H 2001/1266; E01H 2001/128; E01H 2001/1286; E01H 2001/1293
See application file for complete search history.

(56) References Cited

U.S. PATENT DOCUMENTS

| | | | | |
|---|---|---|---|---|
| 3,977,715 | A | 8/1976 | Casci | |
| 4,316,627 | A | 2/1982 | Solypa | |
| 4,360,229 | A | 11/1982 | Kinney | |
| 4,368,907 | A * | 1/1983 | Ross | E01H 1/1206 294/1.4 |
| D342,358 | S | 12/1993 | Castro et al. | |
| 5,269,575 | A | 12/1993 | Parvaresh | |
| 5,503,442 | A | 4/1996 | Lee | |
| 5,628,537 | A | 5/1997 | Kiemer | |
| 5,868,447 | A | 2/1999 | Clark et al. | |
| 6,113,166 | A | 9/2000 | Wynn | |

(Continued)

*Primary Examiner* — Dean J Kramer
(74) *Attorney, Agent, or Firm* — Invention To Patent Services; Alex Hobson

(57) ABSTRACT

A scooper assembly has a scoop container attached to the end of a hiking stick and a bag-retainer for retaining a roll of waste collection bags. The container is configured with a set of teeth that extend out from the bottom of the inlet opening and an outlet opening on the back of the container is configured for dumping feces from the container. The container is configured to retain a bag around the back outlet opening. The bag-retainer has a slot for pulling the end of the roll of bags therethrough, bag-teeth to aid in tearing a bag off from the roll, and a cleat and tray for holding a filled bag. A light-mount is configured to allow positioning of a light in any direction and a detachable rake may be alternately used to collect feces. A receptacle for personal articles and for pepper spray is provided.

15 Claims, 17 Drawing Sheets

(56) References Cited

U.S. PATENT DOCUMENTS

| | | | | |
|---|---|---|---|---|
| 6,196,600 | B1 * | 3/2001 | Miller | E01H 1/1206 15/257.7 |
| 6,260,895 | B1 | 7/2001 | Nichols | |
| 6,641,188 | B2 | 11/2003 | Arceo | |
| 6,732,402 | B1 | 5/2004 | Hsu | |
| 6,941,896 | B1 | 9/2005 | Morin | |
| 7,261,347 | B2 | 8/2007 | Krieger | |
| 7,484,859 | B1 | 2/2009 | Burke | |
| 7,914,056 | B1 | 3/2011 | Peterman | |
| 8,066,311 | B2 | 11/2011 | Axelrod | |
| 8,100,445 | B1 | 1/2012 | Brar | |
| D665,954 | S | 8/2012 | Diehl | |
| 8,939,481 | B1 | 1/2015 | Qi | |
| 8,955,893 | B1 | 2/2015 | Stern et al. | |
| 10,577,765 | B2 * | 3/2020 | Fulbrook | E01H 1/1206 |
| 2002/0038957 | A1 | 4/2002 | Harrison | |
| 2002/0185874 | A1 | 12/2002 | Arceo | |
| 2004/0090073 | A1 | 5/2004 | Edwards et al. | |
| 2004/0164568 | A1 | 8/2004 | Diehl | |
| 2006/0237977 | A1 | 10/2006 | Krieger | |
| 2009/0058114 | A1 | 3/2009 | Diehl | |
| 2009/0072559 | A1 | 3/2009 | Wilkerson | |
| 2009/0095225 | A1 | 4/2009 | O'Connell | |
| 2017/0191235 | A1 * | 7/2017 | Bean | B25J 1/04 |

* cited by examiner

SCOOPER ASSEMBLY

CROSS REFERENCE TO RELATED APPLICATIONS

This application is a continuation of U.S. application Ser. No. 16/514,005, filed on Jul. 17, 2019 and currently pending, which is a continuation in part of PCT application No. PCT/US2018/015549, filed on Jan. 26, 2018, which claims the benefit of priority to U.S. provisional patent application No. 62/451,268, filed on Jan. 27, 2017; the entirety of both applications are hereby incorporated by reference herein.

BACKGROUND OF THE INVENTION

Field of the Invention

The invention relates to a pet feces, such as dog feces, collection apparatus having accessories for the convenient collection and disposal of pet feces.

Background

Pet owners that walk their pets in order to drop fecal waste are required to retrieve and dispose of the waste as a municipal rule, health issue, and common courtesy. Two techniques are common, the use of waste pickup bags where the user must bend down and touch the waste through the bag when retrieving it and the use of a mechanical device. The use of a bag only is highly unpleasant for numerous reasons aside from the tactile issue, and mechanical devices currently in the market generally have only a single strategy for waste pickup, have few or no other additional functional features that enhance the task of waste removal, and none are built sturdy enough to support a user's leaning weight.

Given the particular unpleasantness of fecal pet waste retrieval using a thin plastic bag only as the means for pickup requires the owner to handle and collect the waste with their hand while the waste is warm, smelly and has a range of textures that are equally unpleasant. Furthermore, the pet or dog will often produce several fecal droppings if they move when defecating, and if they defecate more than once during a walk. This makes it difficult to retain the first collected feces while trying to collect the subsequent feces, so gathering the waste more firmly with the hand is required.

Bending down is a physical challenge and limitation for some people. In addition, the pet is typically retained on a leash while the person bends down to collect the feces, and the pet may pull on the leash unexpectedly while the person is in a compromised position, which may lead to the person being pulled to the ground and/or incurring injury. Such incidents happen too often because the person is at a disadvantage having to hold the leash while at the same time having to bend down to retrieve the waste. Precipitation and wet, slippery surfaces from rain or snow increase this hazard.

Once the waste is gathered into the bag and held in the owner's hand through the bag, the bag is turned inside out and then tied off. Generally, one bag is used to retrieve one pile of fecal waste dropped by the pet because the user's hand is usually filled holding the waste. After the bag is tied off, the owner must decide how they are going to handle the bagged waste until they are at an appropriate waste receptacle where they can discard the bag. Typically, the owner simply carries the bag in their hand with the waste 'dangling' as they walk. The smell of the fecal waste may not be completely sealed within these thin bags making for an unpleasant walk until the bagged feces is disposed of. In addition, carrying the bagged feces prevents the person from using the non-leash hand for other tasks, such as operating a cellular phone, or the bag could be held with the leash hand, which is also awkward. Putting the bag in a pocket is undesirable as well.

If a pet owner walks more than one pet on a leash or if one pet defecates more than once on a walk, the retrieval effort and hazards are significantly multiplied. Multiple fecal droppings require additional bags, and more challenges to hold the bagged feces. In addition, pet fecal bags are often provided in a roll and peeling off and separating a bag from the roll of bags, usually held in a bag container of some type, is cumbersome and difficult with the pet owner's hands being occupied with leashes and previously collected bagged feces.

The problem of using one's hand to gather and hold an animal's solid waste with a bag can be avoided when a mechanical waste scoop, rake or shovel is used and there are numerous product types in the market to accomplish this task. The mechanical devices are generally not long or strong enough to provide support to the user in the same way a cane or hiking stick/pole provides support. The devices also typically have moving parts that are not well made causing them to break easily, Generally, pet owners reject the use of devices because they have a reputation for being cumbersome and poorly made, they generally offer only a single means to retrieve waste, and they provide few if any additional functional features that improve efficiency and the quality of life for the user during walks and waste retrieval.

Many types of mechanical waste collection devices exist in the prior art and commercial market. Some use cooperating jaws with springs operated by pulling a squeeze handle to open and close the jaws to collect the waste material inside the two jaws, which then become the holding container for the waste. Others use disposable bags secured around a frame where a spring and handle open and close the device to collect waste. Still others consist of two components, essentially a rake or spade and a pan or bin to collect the waste. Yet another option is a simple metal rake device composed of relatively rigid round tines. The tines curve to form a collection area at the end that holds a single waste until it can be dumped into a waste container.

In general, the prior art and products in the market have a singular function or method for waste collection. In general, most are not sturdy or durable, break easily, and cannot provide support for a user that would enhance stability and safety.

SUMMARY OF THE INVENTION

The invention is directed to a scooper assembly for collecting feces in a convenient and safe manner. An exemplary scooper assembly comprises a hiking stick extending from a handle end to a container end. The hiking stick may be strong and durable to support a pet owner's leaning weight when they walk, similar to a hiking pole or cane. An exemplary hiking stick may be strong enough to support the user as they bend over to collect feces. An exemplary scooper assembly comprises a container that is detachably attached coupled to the container end of the hiking stick by an adapter and has an interior for receiving and retaining the feces. The feces may be scooped into the container through the front inlet opening. A plurality of teeth may extend from the front of the container to aid in retrieval of the feces, especially when being collected from grass or a flat, hard surface. An exemplary container has a back outlet opening for disposing feces from the container interior. Furthermore, the container may comprise a plurality of clips for the detachably attachment of a collection bag. The bag may be configured around the back outlet opening of the container and one or more clips may secure the collection bag to the container and over the back outlet opening. In addition, a door may be coupled to the back of the container that pivots to enable said door to pivot from a closed position, wherein it covers at least a portion of the outlet opening to an open position to allow said feces collected in the container to be dumped through the outlet opening. The bag may be configured around the back end of the container and in a slit or tapered slot between the container and the door connector.

An exemplary scooper assembly may have teeth or tines extending from the front of the container that may have beveled and rounded edges along the extended flattened ends and sides and the slots between the teeth may be rounded between the connected ends of the teeth to prevent feces sticking thereto, to aid in cleaning, and to prevent grass or vegetation from being snagged in instances where the container is swept through flora to collect feces. Furthermore, the plurality of teeth may be flexible to allow bending and may form a concave extended end, wherein the teeth on the outside edges extend further away from the container than the teeth closer to the center. In addition, in an exemplary scooper assembly the outside teeth may extend upward from the container with a side flange extending up from the outside teeth to the container to direct the feces down along the teeth and into the container. The teeth are thus designed for optimal functionality for use on flora and hard surfaces and for channeling the waste into the container center during pickup. The combined features of the teeth are unique from prior art and any poop scoops in the market.

An exemplary scooper assembly may further comprise a rake that is detachably attached to the hiking stick which may be used for the collection of feces. The rake may be used to collect the feces into the container, or it may be used independently when a waste receptacle is nearby, enabling a pet owner to use the rake to collect and transport the feces to a disposal location, such as a waste bin or into a pet waste bag, which avoids touching the waste.

The hiking stick of an exemplary scooper assembly may comprise a handle on the handle end. The hiking stick may be circular in cross section and may be a single piece unit or may comprise a plurality of portions. The plurality of portions may be coupled together, whereby one portion extends into an aperture of a second portion to enable collapsing and setting of a desired length of the hiking stick. The plurality of portions of the hiking stick may be telescoping. A collar retainer may enable a first hiking stick portion to be secured with respect to a second hiking stick portion. The collar retainer may comprise collets or cam locks for securing one portion of the hiking stick with respect to another portion of the hiking stick. The length of the hiking stick from the handle end to the container end may be about 75 cm or more, about 90 cm or more, about 100 cm or more, about 120 cm or more and any range between and including these length values provided. Note that an exemplary hiking stick may be adjustable in height. The container may be detachably attachable to the hiking stick thereby allowing the pet owner to use the hiking stick like a walking or hiking stick. An exemplary hiking stick may be made out of metal or composite materials, such as carbon fiber to reduce the weight. The hiking stick may comprise an internal spring that functions as a shock absorber. The hiking stick may comprise an upper and lower hand grip, a nylon hand strap, a walking tip that is detachably attachable to the container end of the hiking stick, and a circular piece called a basket that screws onto the threaded section just above the tip, which helps prevent the stick from sinking into soft dirt or snow.

An exemplary scooper assembly comprises a receptacle that may be detachably attached to the hiking stick by a receptacle-clip. The receptacle may be configured for retaining personal articles such as a cell phone, keys, wallet or a beverage. In an exemplary embodiment, the receptacle is five sided and has receptacle flanges that extend from the receptacle walls. The receptacle flanges may be rounded to enable a beverage to be slid down into the receptacle, thereby flaring out the flanges to retain the beverage therein. In an exemplary embodiment, the receptacle may have a pepper spray retainer for pepper spray container that may be clipped to said retainer.

An exemplary scooper assembly comprises a bag-retainer that may be detachably attached to the hiking stick by a bag-clip. An exemplary bag-retainer comprises a bag-roll receiver for retaining a roll of bags which may be cylindrical in shape. An exemplary bag-retainer comprises a bag-core interface which may be a spindle or a plurality of tines that extend into the bag spool. The spindle or tines may be sized to provide a positive engagement with the bag spool. In an exemplary embodiment, a plurality of tines flare out from a connected end and are forced inward when a bag spool is pushed thereover. An exemplary bag-roll receiver has a bag-slot for the spool of bags to extend out from the bag-roll receiver. A space may be formed between a vertical arm coming off the bag-retainer clip and the hiking stick shaft where the bag may be pulled through this space in order to engage one or more bag-teeth that may be configured on a vertical arm on the side away from the bag-slot. This may enable an individual bag to be torn from the bag roll at the teeth on the vertical arm of the bag-retainer. The bag-teeth may be rounded and may extend up to engage with the perforations between bags of the bag-roll. The spool of bags may extend out through the bag-slot and around the hiking stick and between the arm wherein the extended bag roll interfaces with the bag-teeth.

After feces is collected in a bag, the filled bag may be tied to form a knot, and the bag may be retained in a bag-cleat configured as two vertical slots along the bag-roll receiver. A bag-roll receiver may have one bag cleat for retaining the bags wherein the knot is slid down on the outside of one cleat slot and the bagged feces portion is slid down on the outside of the other cleat slot. An exemplary bag-retainer may comprise a bag tray for receiving a bag with collected feces. A tray for a filled bag may be configured under the bag-roll receiver whereby bags secured in the bag-cleat can rest in the filled bag tray. The bag-cleat and bag-tray prevents the bags from swinging while the pet owner is walking or using the scooper.

An exemplary scooper assembly comprises a light-mount that may be detachably attached to the hiking stick by a light-mount clip. The light-mount enables lights of various sizes to be inserted and retained in the light-mount. The light-mount has an insert end and a body having individual leaves that taper down to a protrusion end. The protrusion end may comprise flared light flanges for the insertion of small diameter lights. The individual leaves may taper in dimension as they taper down to reduce the internal area of the light-mount. Any number of leaves may be used such as three or more, four or more, five or more, six or more and any range and including these numbers, but five leaves are preferred. A light-mount may have a light pivot that allows the light-mount to rotate. The light-mount clip may be configured to rotate about the hiking stick. The combination of the light pivot and rotation about the hiking stick clip gives two degrees of freedom to position the light beam produced by a light retained therein.

An exemplary scooper assembly comprises a rake that may be detachably attached to the hiking stick by a rake clip. The rake may comprise a plurality of teeth and a rake-pan to retain feces, and a rake handle for manipulating the rake. The rake may be configured to detachably attach to the container and may have rake-slots or other attachment features for this purpose. The slots may be slid into a protrusion from the container, such as the inlet opening wall of the container.

An exemplary scooper assembly provides a unique and improved system and process for collecting feces. An exemplary scooper assembly provides a number of different methods for collecting feces. In one embodiment, the scooper assembly is used for raking feces into the container for direct disposal and in another for bagging fecal waste, wherein a bag is coupled to the outlet opening of the container. An exemplary scooper assembly comprises a plurality of accessories that enhance the usability, utility, and efficiency of handling animal waste during walks, hikes and other outings. In another embodiment, the scooper assembly comprises a detachably attached rake that can be used directly for the collection of feces or used to rake the feces into the container. In still another embodiment, the rake is coupled to the container to block a portion of the container from coming into contact with the feces.

An exemplary scoop container has a set of teeth or tines, that may be made from a plastic or plastic composite material that flexes, cleans easily and has anti-microbial properties. The curved teeth flatten at the tips to facilitate waste retrieval. The extended ends of the teeth may form a concave shape to direct waste toward the center of the container when it is slid or swept under the waste. The inside sections, or slots between the teeth may be curved and smoothed so that grass or other materials are not grabbed by the scooping action. The outside teeth may have raised sides that keep the waste channeled to the inside.

An exemplary scoop container is generally rectangular in shape and has dimensions that have approximate size limits. The front opening may be about five inches wide and about four inches high plus or minus a half inch; which yields an outside perimeter or girth of about eighteen inches. The container may also be tapered toward the back or the outlet opening, which enables industry-standard waste bags to fit onto the container from the back.

The industry standard width and length for waste bags that come on a roll are as small as about eight by twelve inches and as large as about nine by fourteen inches. This means an unfolded bag of eight inches has a perimeter of sixteen inches when opened; and the nine-inch bag perimeter is eighteen inches. The tapered design of the container can accommodate both the sixteen and eighteen-inch perimeter bags. Waste bags sold in a box have wider perimeter openings that also easily fit onto the container.

The exemplary scoop container comprises at least one clip which may be configured on the top of the container for retaining a bag around the outer perimeter and over the outlet opening. Additional clips may be configured on the left and/or right side of the scoop container. In an exemplary embodiment, a bag is retained around the back of the container by a clip on the top and in the tapered slot or slit between the bottom of the container and the door connector. An exemplary clip has smooth surfaces to prevent the relatively thin waste bags from tearing when attached or removed from the container. The clips may produce enough retention force to hold a bag having several pounds of feces therein. When the bag is dropped from the back of the container, the clips hold it in place as the user grabs the bag to remove it. The length of the clips and the tapered container shape allows for the attachment of both the sixteen and eighteen-inch perimeter industry standard bags from rolls.

An exemplary scoop container has a unique slit or slot formed between the bottom underside of the container and the top of the lower back door connector attached under the container. The slit tapers to a point toward the front of the container and opens at the back end in front of the hinge on the back door. This slit is important because when the user slides the waste collection bag into the slit, it provides support to hold the bag in place. In addition, when the bag is inserted into the slit and the remaining bag is loosely placed into the inside of the container, the outside of the bag is shielded from being exposed to residual waste on the ground. In similar fashion, the inside of the bag within the slit is shielded from being exposed to waste collected and held inside the scoop container. When the container is raised to drop fecal waste into the bag for removal, the inside portion of the bag shielded from waste is clean when the bag is tied off and the outside of the removed bag is also clean from waste for safe, hygienic handling.

An exemplary scoop container has an attachment feature, such as a threaded housing, on the top that mounts or detachably attaches to the hiking stick. In an exemplary embodiment, an adapter is configured between the hiking stick, or attachment feature of the hiking stick and the attachment feature or housing of the container. An exemplary adapter may have a threaded portion for attachment to the hiking stick and a threaded portion for detachable attachment to the container; one portion may be male threads and one portion may be female threads. An exemplary hiking stick may be a hiking stick which typically has tapered threads for the attachment of a basket. An exemplary adapter is a unique and critical design component because it allows for the attachment of hiking sticks that may have different thread sizes or methods for attaching the basket at the end of the stick. This allows the scoop container to be universally detachedly attached to most hiking sticks. In an exemplary embodiment, the housing of the container attachment feature and the adapter are open inside to allow the steel tip of the hiking stick to extend down through the opening when the stick is detachedly attached.

An exemplary scooper assembly comprises a hinged back door that opens so the waste bag can be attached. Once the bag is attached through the slit between the bottom of the container and the door connector, and the top and side clips, the remainder of the bag hangs out loosely from the container. A user then pushes the entire loose bag into the inside of the container and closes the back door. The back door is secured shut by magnet catches, although other catches and latching devices could be used with similar effect. As the user collects waste, it rests against the loose bag inside the container until the user decides to remove the bag by opening the back door. The "Method of Use" section provides more details about this process.

An exemplary scoop container has a ridge or rib on the top and sides connected to the adapter housing. This provides added strength to the structure so that it can support a user's leaning weight at a level or amount similar to a hiking stick. The rib also has two cleats on either side of the adapter housing that may secure the excess bag and handles from industry standard waste bags that come in a box dispenser.

Each cleat appears as an angled piece with two sharp v-shaped edges that pinch the bag or handles when inserted into them. In effect, the cleats provide an added means to attach a bag to the container.

In summary, an exemplary scoop container has teeth across the front that are optimized for scooping waste. An exemplary container has a threaded housing for attaching the threaded adapter, which connects the hiking stick to the container. An exemplary scoop container has clips and an underside tapered slit that secures the waste bags onto the container. The back door can be used to further secure the bag in place. An exemplary scoop container has a rib around the top and sides that reinforces the scoop container for added strength to better support a user. Finally, the rib has two cleats that can be used to secure a bag that has handles or a wide opening.

An exemplary scooper assembly has a rake accessory that attaches to the hiking stick by a snap-on rake retainer clip. When detached from the hiking stick, the rake has multiple uses. It is an alternate means for scooping or shoveling waste to deposit in a bag or waste receptacle other than the scoop container. The rake accessory also allows the user to remove the scoop container for long hikes, so it becomes the primary means for retrieving fecal waste. The scoop may also be used as a rake to reposition waste on the ground for pickup by the scoop container or for raking the feces into the container such as when the waste is on uneven ground or collection is impeded by some other structure adjacent to the waste. An exemplary rake can be attached to the front of the scoop container as a barrier so waste is collected and held temporarily until it can be dropped into a waste receptacle. This is the best method when the user does not have a waste bag. The rake has a cross-shaped slot on the handle that fits snugly onto the front top cross-shaped edge of the scoop container.

The bag-retainer accessory is designed to fit an industry standard roll of waste bags, which vary in thickness. Industry standard waste or feces bags are commonly about 8"×12" (20.3×30.5 mm) and 9"×14" (22.9×35.6 mm). A roll of bags typically consists of 15, 20 or 30 bags based on the thickness of bags that varies from about 12 to 24 microns. The dimension of an industry standard bag roll is about 2 5/16 inches (58 mm) in height and about 1 3/8 inches (33 mm) in diameter. Each roll has a plastic center tube that has an inner diameter of about 5/16 inches (8 mm). An exemplary bag-retainer accessory has a bag core interface which may be a multi-pronged component extending from the bottom of the holder and up to provide a support shaft that the bag roll can be pushed down over to secure it in place while allowing the bag roll to easily rotate. An exemplary bag-retainer accessory has a bag-slot for the extended end of the roll of bags to pass through for retrieval and removal of a single bag.

An exemplary bag-retainer accessory also has a vertical arm that extends from the bottom of the holder and then runs parallel along the hiking stick. An exemplary bag-retainer accessory has a plurality of bag-teeth on the arm opposite from the bag-slot that are used to tear a bag off when it is pulled out from the holder bag-slot and then passed between the arm and hiking stick shaft. The arm design is unique and enhances the separation of a bag from the roll. It also leaves part of the next bag exposed so it is easier to start the process the next time.

An exemplary scooper assembly may include rolls of bags imprinted with text and arrows to allow the user to see and anticipate where the perforation is located as the bag is pulled from the bag roll. This may enable the user to easily align the perforation with the bag-teeth for tearing and detachment of a bag. The imprinted bag may also indicate which end the bag should be opened, which is often a problem for users when the bag is unfolded after being torn off the roll.

An exemplary bag-retainer accessory may comprise a cleat for retaining a filled bag having feces collected therein. An exemplary cleat may be two vertical slots along the wall of the bag roll receiver. The user may take the tied filled bag, having a knot toward the open end and thread the filled bag through the one cleat slot with the knot on the outside of the wall and the filled portion of the bag, or closed end, pulled through the other cleat slot on the outside of the bag-retainer wall. In this case, a small section of bag is retained within the bag-retainer between the two cleat slots. The filled bag may rest within the filled bag tray that extends under the bag roll receiver and cleat. In an exemplary embodiment, the filled bag tray circles most of the lower part of the bag roll receiver. This is a convenient feature for users when a waste receptacle is not available. Pet owners who use just bags for picking up waste with their hands have the unpleasant dilemma of what to do with a waste-filled bag as they walk their pet(s). Typically, these pet owners walk around dangling the bag in one of their hands since placing it inside a pocket or elsewhere is an undesirable prospect. The waste receptacle on the bag-retainer with the cleat slots to secure the waste-filled bag conveniently stores the waste until a suitable waste receptacle is encountered.

An exemplary light-mount accessory can accommodate different sizes of tubular flashlights, such as LED flashlights, from as small as about one-half inch diameter to as large as about one and one-quarter inch diameter. An exemplary light-mount accessory has a unique pentagonal design having five flat edges from which flexible leaves come off and taper down to hold the flashlight centered in place. When the user inserts the flashlight, this spreads the leaves open. The bottom of each leaf is thicker than the tapered section where they come together, and the ends curve outward. While a small diameter flashlight could be inserted from the bottom, or protrusion end, and held firmly in place, larger diameter flashlights could be inserted into the holder by pushing down from the insert end. The flashlight is optimally removed by pushing down on it until the user can grab it from the bottom and pull it through. In other words, the flashlight is not meant to be pushed back out from the leaves through the insertion end, although it may be possible to remove it that way.

An exemplary light-mount accessory fits tightly onto the hiking stick by a light-mount clip, which may be a snap-on clamp or a hinged clamp or clip with a spring similar to an alligator clip on a battery jumper cable. The clamp or clip allows the light-mount accessory to rotate on the hiking stick. In addition, a tight-fitted connector allows the flashlight holder to rotate 360 degrees. This fitting has two sides, with a spring and small depressions and elevations inside that create positions clicked into place as the fitting rotates. Between the rotation of the clamp or clip and the rotary fitting, the user can position the flashlight beam in countless directions, including the front of the scoop container when collecting fecal waste in a low-light situation.

A preferred location of the light-mount accessory is on a lower portion or section of the hiking stick; as close to the scoop container as practicable. This ensures that maximum light can be directed toward the scoop container teeth and a front area where waste is collected.

The receptacle accessory is intended to be attached to the top of the hiking stick, so its weight has the least effect on utilization of the scoop, whereby it is closer to the handle end. An exemplary receptacle accessory has a pentagon shape that creates flat edges from which five leaves extend out and flex open to secure or snugly fit a variety of disposable cone-shaped cups and plastic battles or other articles. An exemplary receptacle accessory is detachably attachable to the hiking stick with a receptacle-clip such as a clamp or hinged spring clip similar to the ones used for the other accessories. An exemplary receptacle accessory also has a slot on the side that is intended for a pepper spray container that has a clip-on piece similar to a ballpoint pen clip. The slot has a rectangular shape, with an outside edge that is thickest at the top and tapers down to a very thin edge at the bottom. This feature allows the pepper spray to be grabbed and pulled rapidly from the somewhat hidden slot. Because of the slot design, the action of grabbing and deploying the pepper spray can be accomplished within two seconds, as determined by tests.

METHODS OF USE

This section describes the preferred methods for removing a bag from a roll of bags, attaching the bag to the scoop container, using the scoop container to collect waste, removing the bag from the scoop container, and a few recommended tailored configurations for the invention.

First, the user acquires a bag by pulling the end of the roll of bags inserted inside the bag-retainer. Once the bag comes out from the bag-slot, the user threads the bag through the adjacent arm and against the hiking stick. As the user passes the bag through between the arm and hiking stick, the plurality of teeth catches the perforation of the bag end and starts to tear it off from the roll. The user facilitates this process by pressing against the top of the arm to keep it tight against the hiking stick when pulling the bag apart and then pulling the bag down and away as it tears completely off the roll. Finally, the user unfolds the bag to its full dimensions and then opens the bag to attach it over the back outlet opening of the scoop container.

The user attaches the waste bag to the scoop container by placing the front of the scoop container face down, so it rests against the front teeth. Next, the user opens the back door and inserts the bag into the tapered bag-slit configured between the bottom of the container and the door connector. The user slides one side of the bag into the bag-slit as far as it will go. The user then attaches the bag to the container by slipping it under the clip or clips. The clips may be configured on the top and/or on the sides of the scoop container. The container is tapered toward the back. This ensures the bag fits tightly over the back of the tapered container. Next, the user pushes the bag into the inside of the scoop container through the back opening and then closes the back door to engage the door clip, such as magnets. The bag sits loosely inside the scoop container.

The scooper assembly is now ready for use. Once a pet completes a bowel movement, the owner holds the invention by the handle with one hand and uses a sweeping action to position the teeth under the waste and scoop it into the container, Upon completion of the sweeping action, the user raises the scoop container above the ground level. The waste collects inside against the loose bag, which is pressed or collapsed against the back door. A user on a longer walk and/or with multiple animals may collect a number of droppings based on the fecal volume.

The user removes the filled waste bag by tipping the scoop container up so that the teeth are vertical to the ground. Next, the back door is opened and as the bag drops down with the waste dropping inside, the user grabs the bag and then pulls it out from the clips and out of the slit. The bag is tied and discarded in a waste receptacle. Alternatively, the bag may be threaded through the two slots on the bag-retainer accessory that function as a cleat to secure and store the bag so that the waste material rests inside the filled bag-tray until a suitable waste receptacle is encountered to discard the filled bag.

The scooper assembly offers many options for tailored use. An exemplary multi-portion hiking stick can accommodate different user heights and preferences as the length is easily changed. When the collets or cam locks are well tightened at each metal telescoping section, the stick can provide a significant amount of leaning weight support for users who want additional stability. Reinforcement of the scoop container augments the hiking stick's capacity to provide weight support and stability. Note that the hiking stick may also be a single piece unit without multiple telescoping portions or any length adjustment features. The accessories may also be used on a walking cane/stick, a four-legged walker, or a wheelchair if the tubular diameters fit the fixed or alligator spring clips on the accessories.

The scooper assembly optimal use is with the scoop container and the four accessories attached. The scooper assembly is lightweight, enabling the user to operate the scoop easily for waste retrieval. The scooper assembly permits one-handed operation so the user can hold pets on leashes with the other hand.

The enhanced utility of the scooper assembly is best realized when the user tailors the modular system for a specific situation. During a long hike, for example, a nylon mesh or plastic bag can be used to store unused, clean accessories for later use if desired. For a lightweight option or a short outing, the user can remove the scoop container and only attach the bag-retainer and rake to the hiking stick. The receptacle accessory with the pepper spray slot comes in handy for certain users, such as those who want to carry a product for self-defense. The light-mount is highly useful as it lets users carry a light to see and be seen in the dark. A light is needed in the dark in order to identify waste for pickup on the ground. The light can also be easily removed from the mount for other uses as desired by the user.

In summary, the scooper assembly is an efficient, multi-functional system for effective pet waste retrieval. Its combined features are unique and, taken together, the components and accessories create a system where the whole is greater than the sum of its parts.

The summary of the invention is provided as a general introduction to some of the embodiments of the invention and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
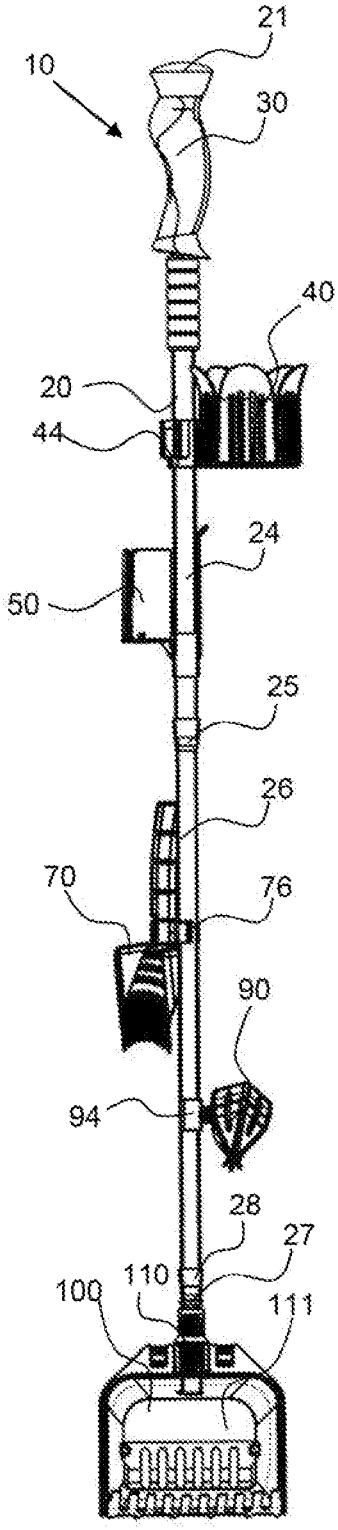
FIG. 1 shows a front view of an exemplary scooper assembly.
Figure 2:
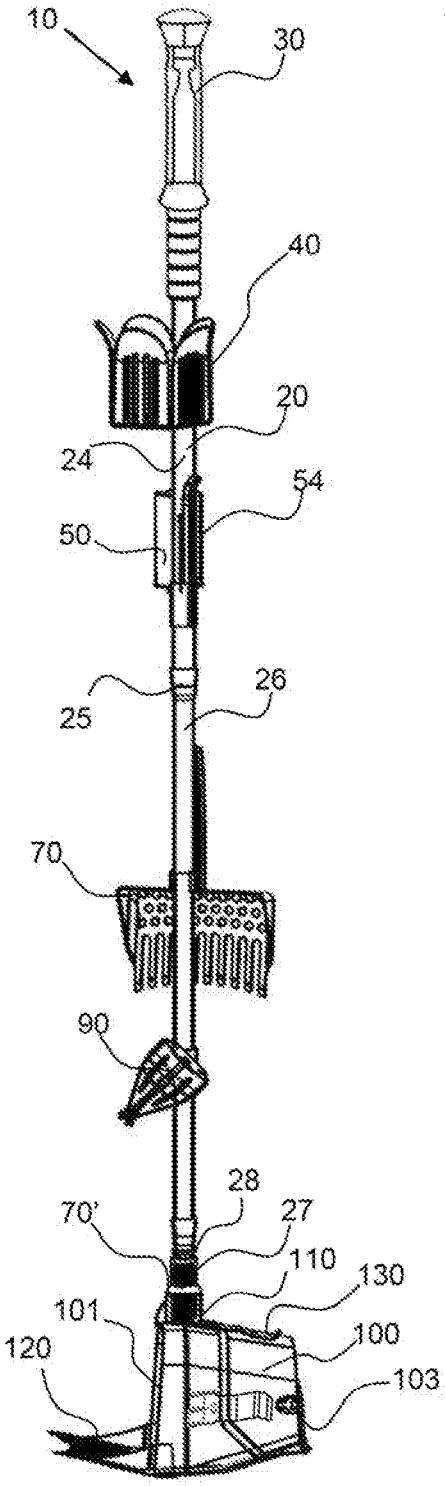
FIG. 2 shows a right side view of an exemplary scooper assembly.
Figure 3:
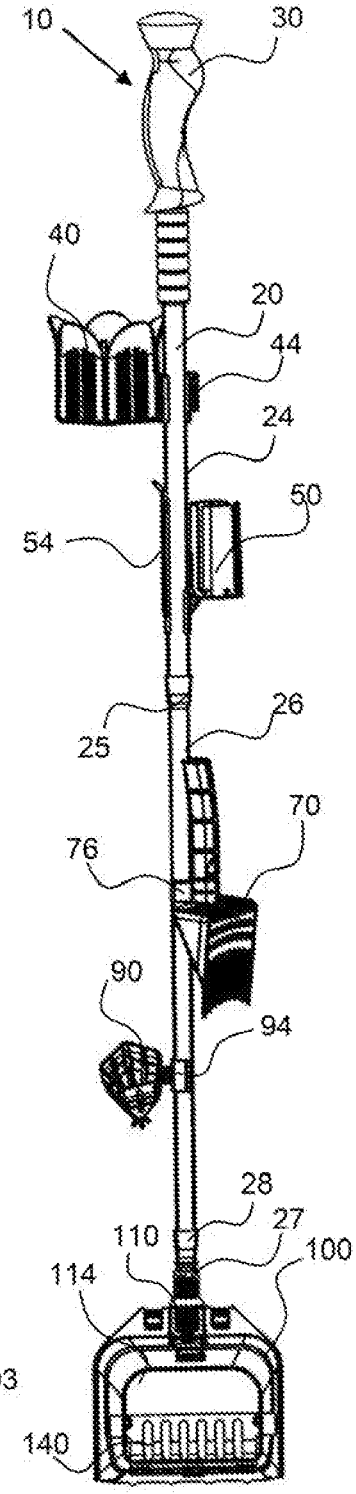
FIG. 3 shows a back view of an exemplary scooper assembly.
Figure 4:
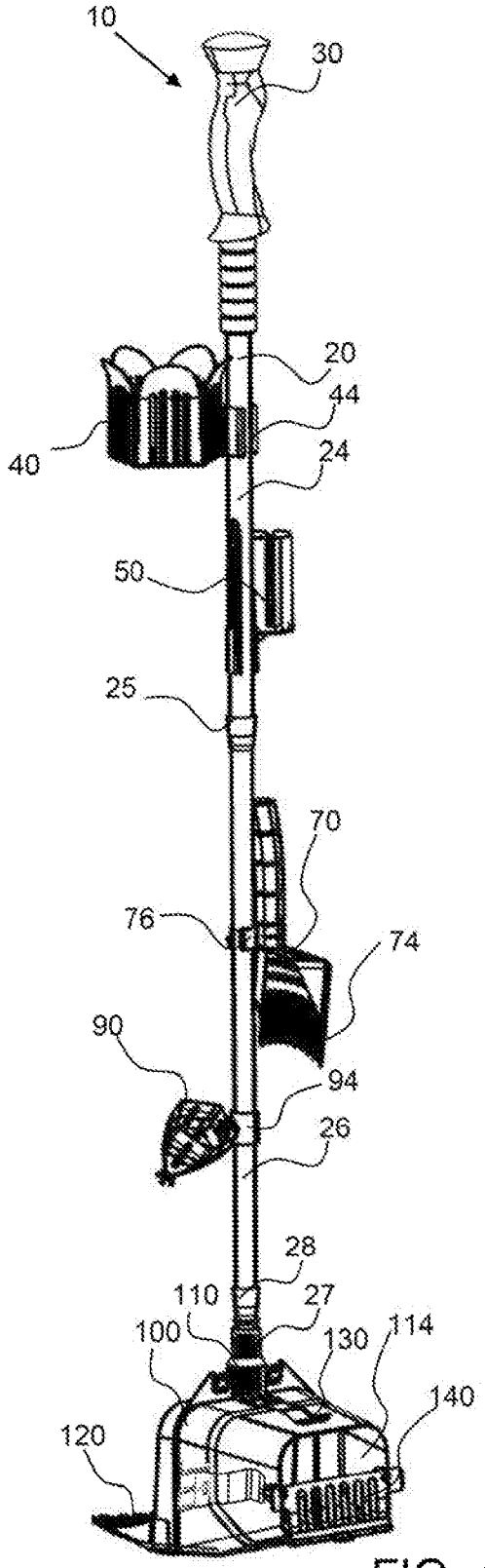
FIG. 4 shows back perspective view of an exemplary scooper assembly.
Figure 5:
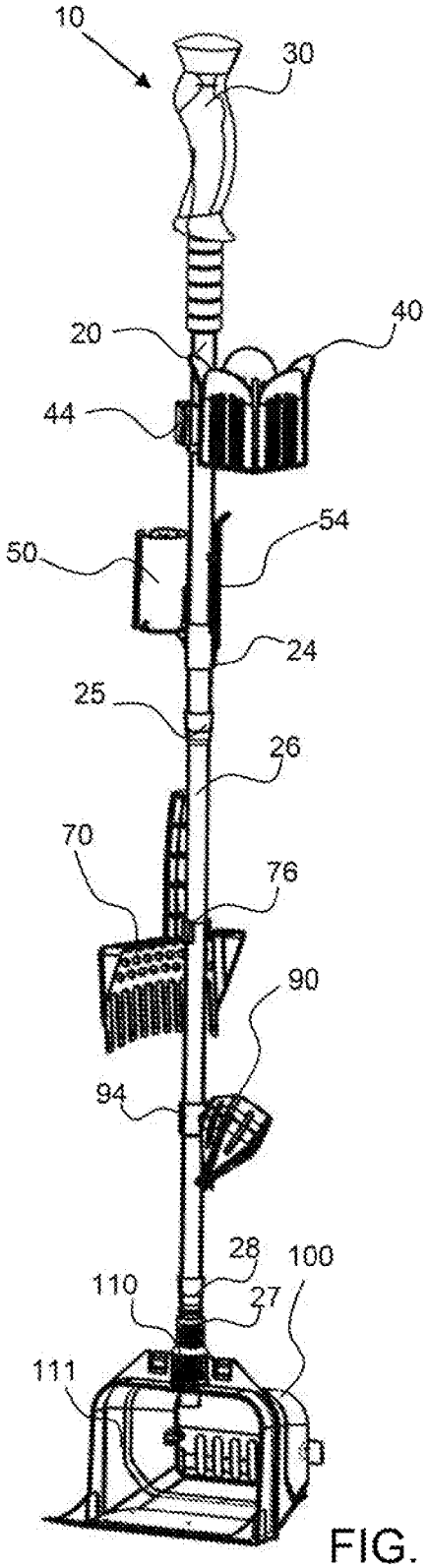
FIG. 5 shows a front perspective view of an exemplary scooper assembly.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION F THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Referring to FIGS. 1 to 5, an exemplary scooper assembly 10 comprises a container 100 coupled to a hiking stick 20 and configured to scoop up animal feces. The hiking stick is coupled to the container by an adapter 27 that is coupled to a container attachment feature 110. A plurality of components are coupled to the hiking stick including a receptacle 40, a bag-retainer 50, a rake 70 and a light-mount 90.

The hiking stick has a length from a handle end 21 to a container end 23, wherein the hiking stick is detachably attached to the container by a hiking stick attachment feature 28, such as threads. The container may be detached from the container end of the hiking stick by this hiking stick attachment feature 28. The container may be threaded onto an adapter 27 which extends between the attachment feature of the hiking stick, male threads for example, and the container attachment feature 110, such as a housing with female threads, on top of the container 100. The adapter 27 may have two threaded portions. The exemplary hiking stick comprises a first portion 24 and a second portion 26 coupled by a hiking stick coupling 25 which may enable one portion of the hiking stick to slide within the other portion of the hiking stick to adjust the length of the hiking stick and/or to compress the hiking stick length for transport and storage. An exemplary hiking stick coupling may comprise a collar that is rotated to retain the two hiking stick portions in a fixed position. A handle 30 is configured on the handle end of the hiking stick and may have contours to provide a firm and positive grip.

The exemplary receptacle 40 is coupled to the hiking stick by a receptacle-clip 44 and provides a convenient place for a beverage, wallet, cell phone and other personal articles. The receptacle may be detachably attachable to the hiking stick.

The exemplary bag-retainer 50 is coupled to the hiking stick by a bag-clip 54 and has a bag-retainer portion for a roll of new bags and a filled bag tray (not shown) may be coupled to the bottom of the bag-retainer portion. The bag-retainer may be detachably attachable to the hiking stick.

The exemplary rake 70 is coupled to the hiking stick by rake-clip 76 and can be detached and coupled to the container 100 to form a gate over the inlet opening 111 of the container, as shown in subsequent figures. The exemplary rake may be detachably attachable to the hiking stick.

The exemplary light-mount 90 is coupled to the hiking stick by a light-mount clip 94 and is configured to receive a light, such as a flashlight that can be directed in any desired direction. The exemplary light-mount may be detachably attachable to the hiking stick. Each of the elements attached to the hiking stick will be described in more detail with reference to later figures.

Figure 6:
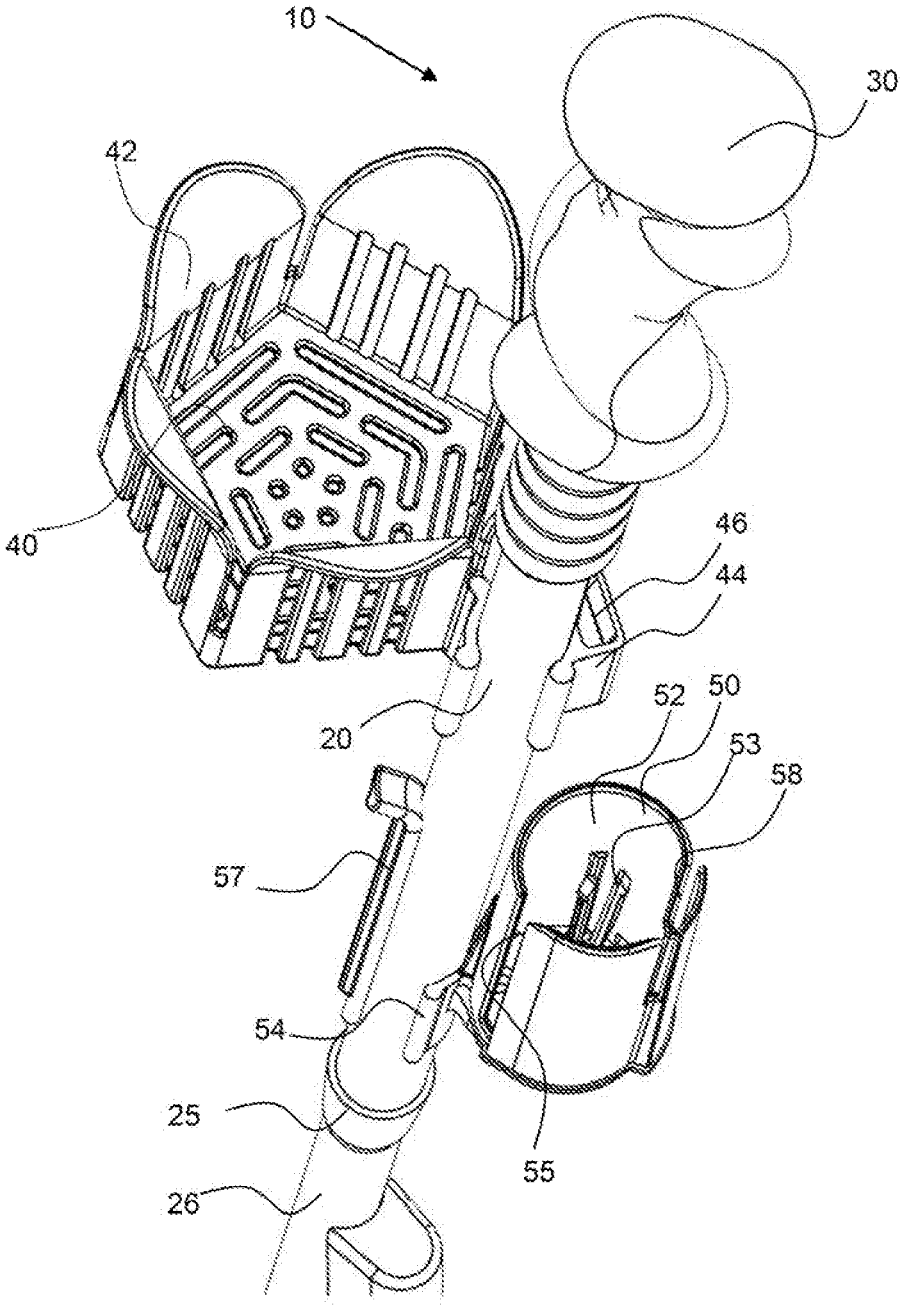
FIG. 6 shows an exemplary receptacle and bag-retainer coupled to the hiking stick of an exemplary scooper assembly.

As shown in FIG. 6, an exemplary receptacle 40 is coupled to the hiking stick 20 by a receptacle-clip 44. The receptacle is five sided having five leaves 42 that flare outward and that are configured to deflect outward when articles are placed therein, such as a beverage container. A separate pepper-spray retainer 46 is configured in the receptacle-clip 44 and provides for quick access to the pepper-spray in the event of an emergency.

Figure 7:
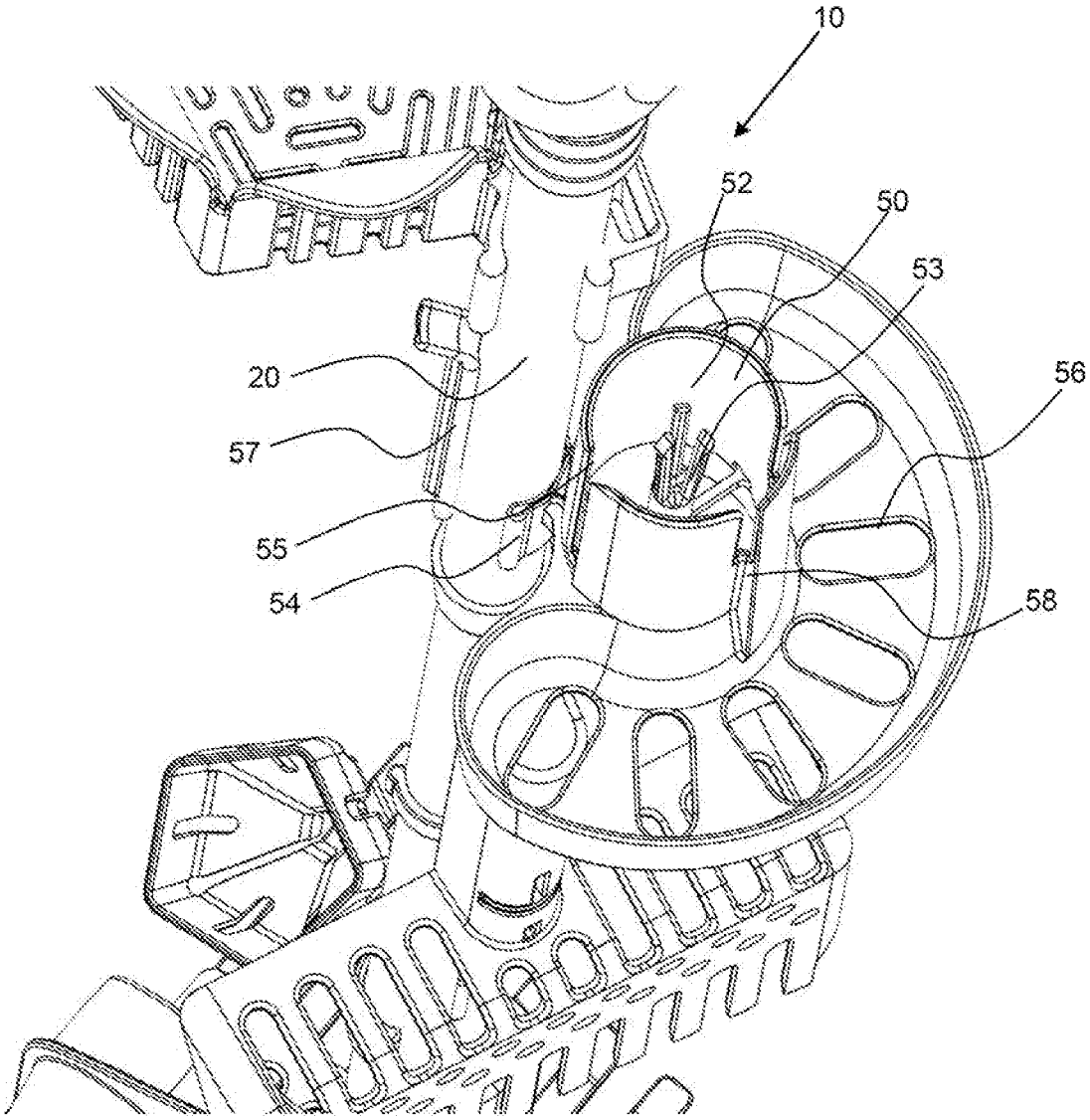
FIG. 7 shows an exemplary bag-retainer coupled to the hiking stick of an exemplary scooper assembly with a filled bag tray.
Figure 8:
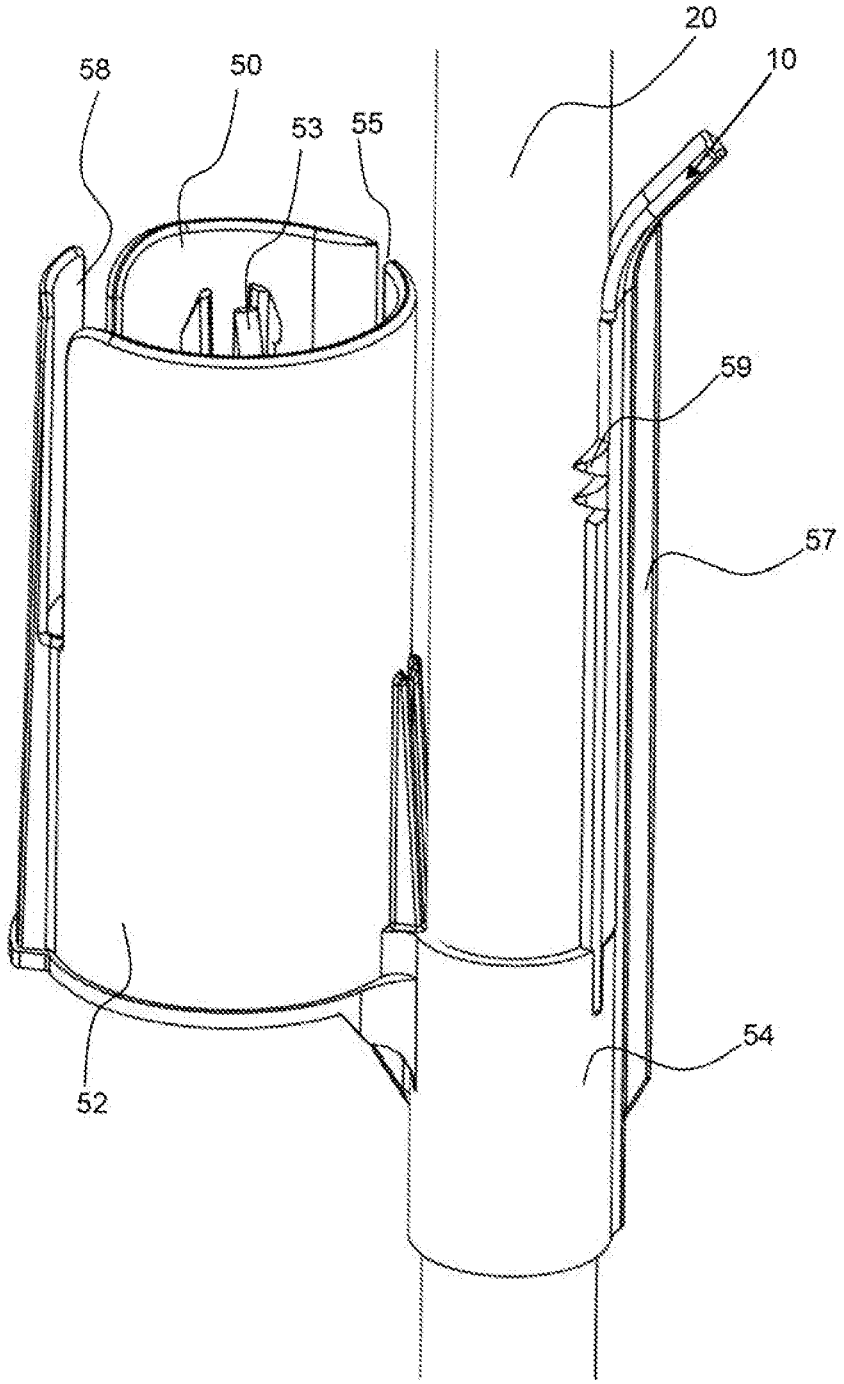
FIG. 8 shows an exemplary bag-retainer coupled to the hiking stick and the bag-teeth configured to tear an individual bag free from a roll of bags; for ease of illustration, the filled bag tray shown in FIG. 7 is not depicted.

Referring now to FIGS. 6 to 8, an exemplary bag-retainer 50 is coupled to the hiking stick 20 by a bag-clip 54. An exemplary bag-retainer 50 has a new bag or bag roll receiver 52. The bag roll receiver has a cylindrical portion with a bag core interface 53 centrally located therein. The exemplary bag core interface 53 shown comprises three tines that flare outward to engage with the bag core when slid thereon. A roll of bags may be slid down into the bag roll receiver with the core of the bag roll extending around the bag core interface 53. A new bag may be pulled from the roll and detached when needed. The bag-retainer has a bag-retainer arm 57 that is used to tear a bag from the roll inside the retainer.

A bag-slot 55 in the bag-retainer 50 allows the free end of the bag-roll to extend out and around the hiking stick 20, wherein the extended roll of bags engages with the bag-teeth 59 at the top of the bag-retainer arm 57, shown in FIG. 8. A roll of bags has perforations between the bags on a roll. The bag-teeth are configured to catch on these perforations to enable easy detachment of a single bag from the bag roll. After a bag is used to collect feces, it is removed from the scoop container and typically tied in a knot where it can then be retained on the cleat 58, shown as two slots in the wall of the bag-retainer. The knotted end of the bag may be configured by pushing the bag down through a slot on one side of the outside bag-retainer wall and then pushing the other end of the bag down to where the bagged feces hangs from the other cleat slot on the outer side of the bag-retainer 50 wall. The feces end of the bag may then rest in the filled bag tray 56, as shown in FIG. 7. The filled bag tray may be part of the bag-retainer or a separate component that is detachably attachable to the bag-retainer or the hiking stick, but it is depicted as the bottom part of the bag-retainer.

Figure 9:
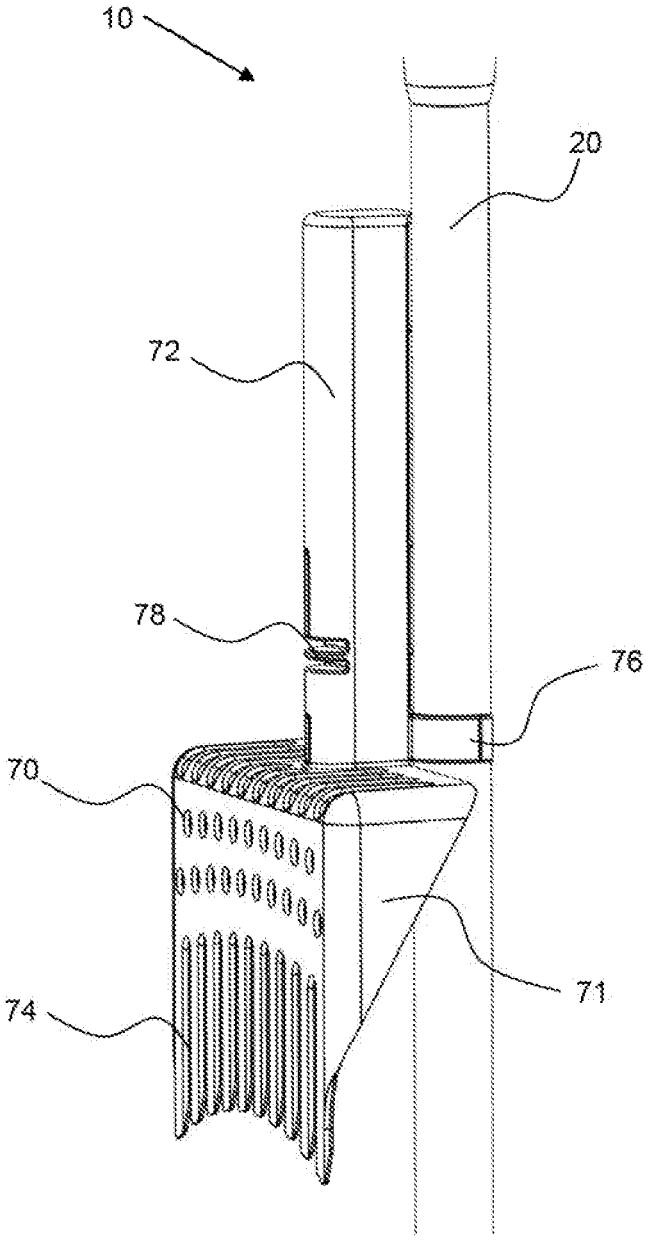
FIG. 9 shows an exemplary rake coupled to the hiking stick of an exemplary scooper assembly.
Figure 12:
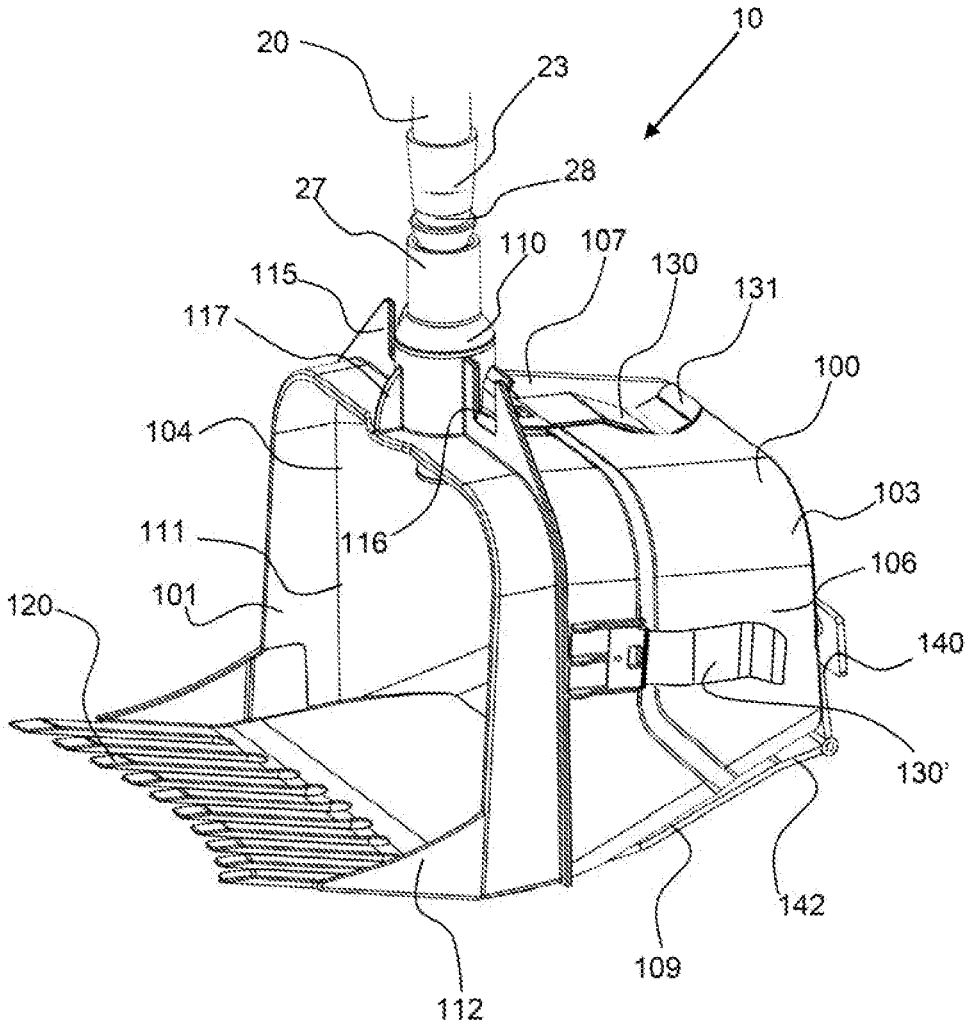
FIG. 12 shows a side perspective view of an exemplary container of a scooper assembly.

As shown in FIG. 9, an exemplary rake 70 is coupled to the hiking stick 20 by a rake-clip 76. The rake comprises a rake handle 72, a rake pan 71, rake teeth 74 and a rake attachment slot 78. As shown herein, the rake may be detached from the hiking stick and coupled to the container by slot 78 to the rake container connector 117 on the scoop container 100 shown in FIG. 12 to form a gate, which prevents feces from entering the inside of the container. In this instance, the scoop container acts as a rake only to hold feces until a disposal means is encountered.

Figure 10:
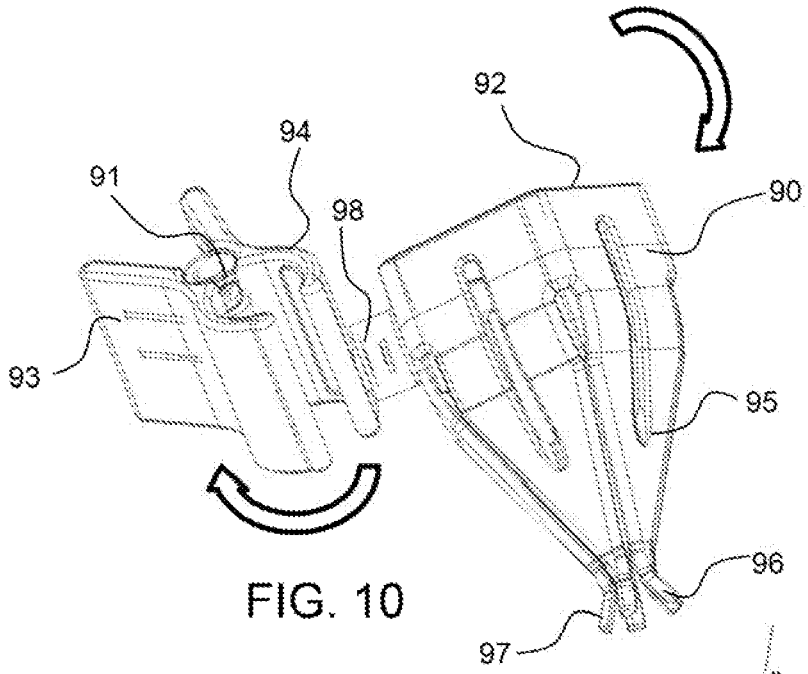
FIGS. 10 and 11 show an exemplary light-mount coupled to the shaft of the hiking stick by a mount clip.
Figure 11:
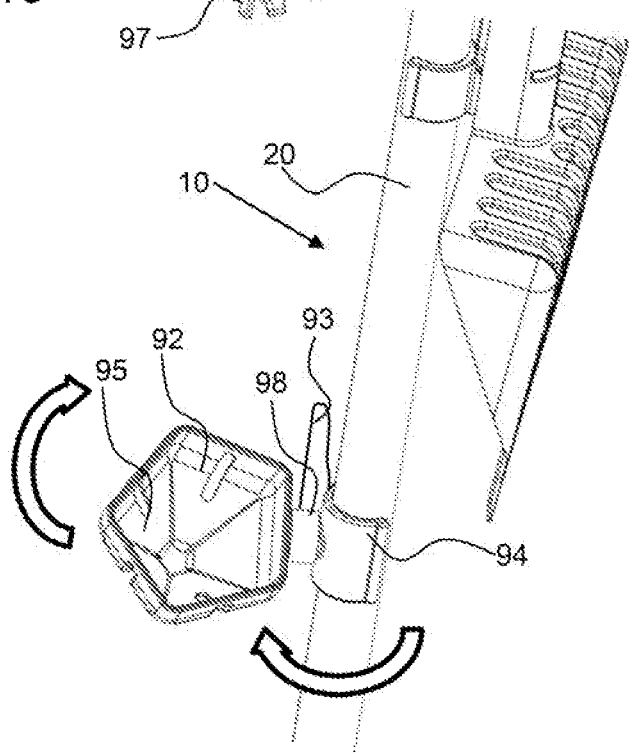

As shown in FIGS. 10 and 11, an exemplary light-mount 90 is configured for detachable attachment to the hiking stick 20 by a mount clip 94. The exemplary mount clip is a spring clip comprising a spring 91 and two clip extensions 93 for opening the mount clip 94. The light-mount 90 is coupled to the mount clip by a light pivot 98, that allows the light-mount to rotated with respect to the shaft. The exemplary light-mount has an insert end 92 for receiving a light, such as a flash-light and a protrusion end 96, through which the light protrudes when retained by the light-mount. A plurality of leaves 95 taper down toward the protrusion end and are deflected outward by a light when inserted therein to positively retain the light. A small diameter light, such as a pen light having a small diameter may be inserted through the protrusion end. The flared light flanges 97 extended on the protrusion end to enable small diameter lights to be inserted through this end. The light may be directed in any direction as the mount-clip may rotate about the hiking stick and the light-mount may rotate about the light pivot 98, as indicated by the bold curved arrows.

Referring now to FIGS. 12 to 18, an exemplary container 100 is coupled to the container end 23 of the hiking stick 20 by the hiking stick attachment feature 28. The container has a height from the top 107 to the bottom 109, a depth from the front 101 to the back 103, and a width from the left side 104 to the right side 106. A receiving volume is defined within the interior of the walls of the container. Teeth 120 extend from the inlet end of the container and are configured to aid in the collection of feces. The teeth have rounded ends and extend at an angle upward from the bottom of the container. The extended ends of the teeth are configured in a concave shape with the teeth along the edges extending further from the container than the teeth more proximal to the center. A pair of inlet side-flanges 112 extend from the container along the edges of the outer teeth to prevent feces from sliding off the teeth before being collected in the container. A rib 115 extends around the top and sides to add strength to the container to provide stability to a user by being able to support the user's leaning weight. Two cleats 116 are provided on each side of the top rib 115 to secure larger bags and bags with handles.

Figure 13:
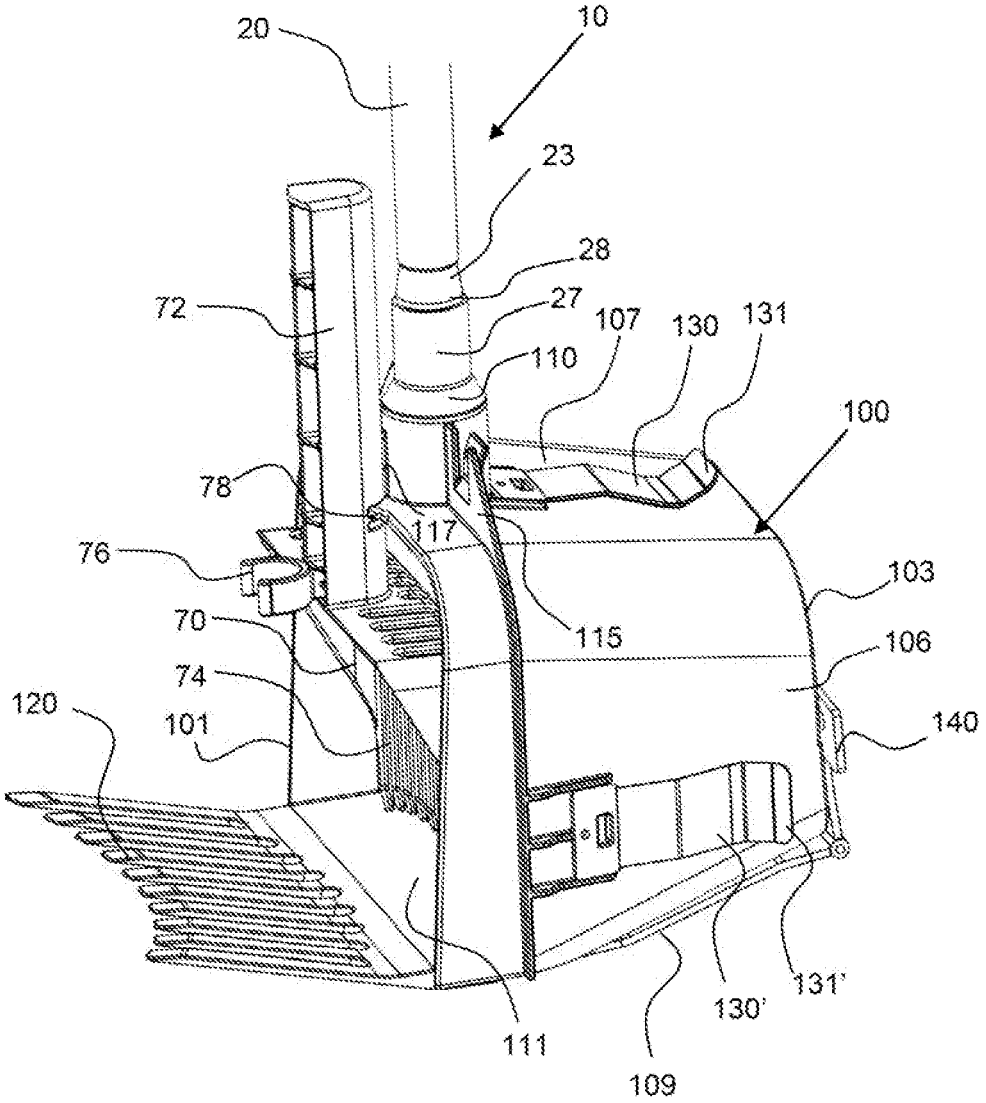
FIG. 13 shows a side perspective view of an exemplary container of a scooper assembly with a rake coupled over the front inlet opening of the container.
Figure 14:
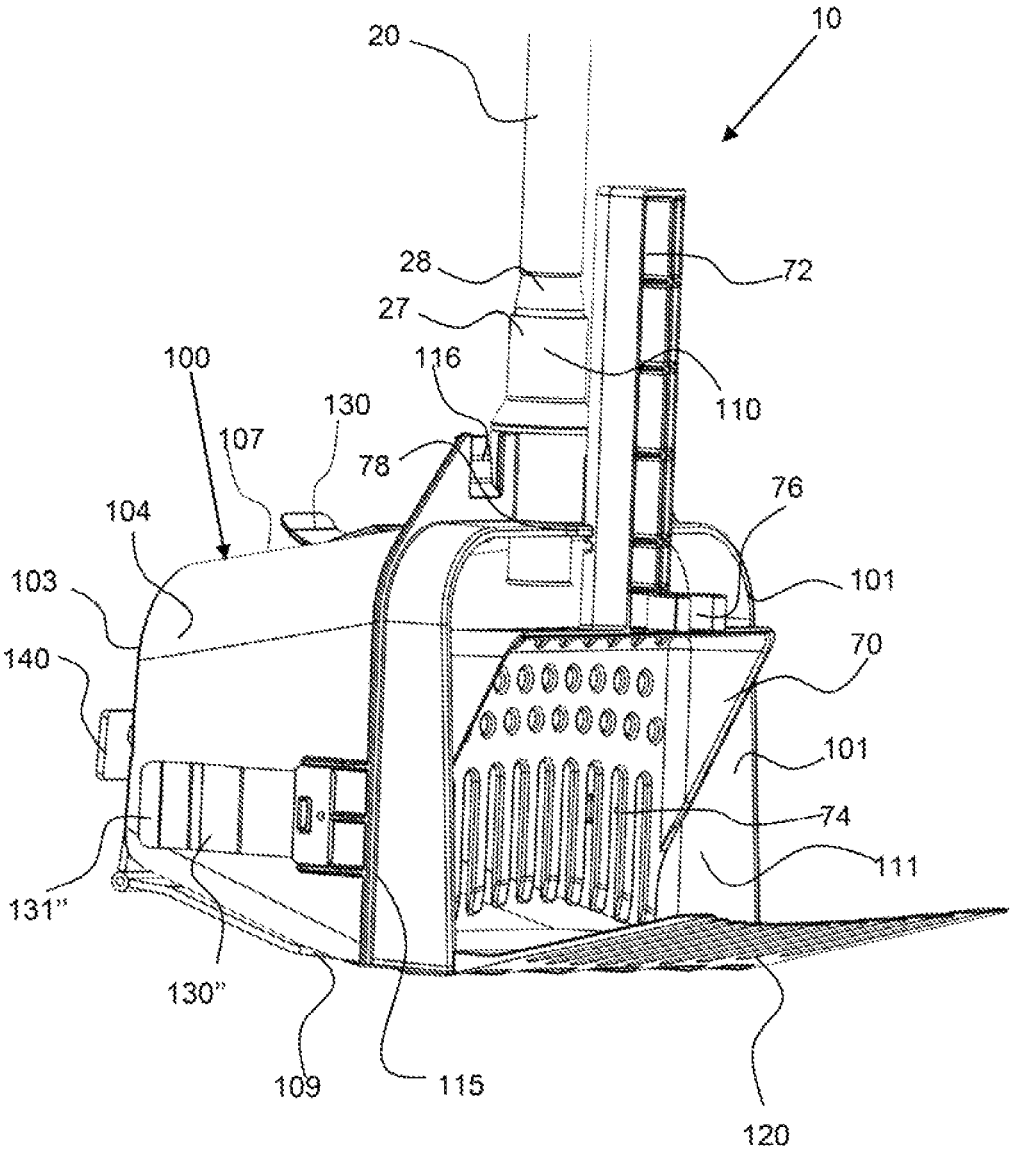
FIG. 14 shows a front perspective view of an exemplary container of a scooper assembly with a rake coupled over the front inlet opening of the container.
Figure 15:
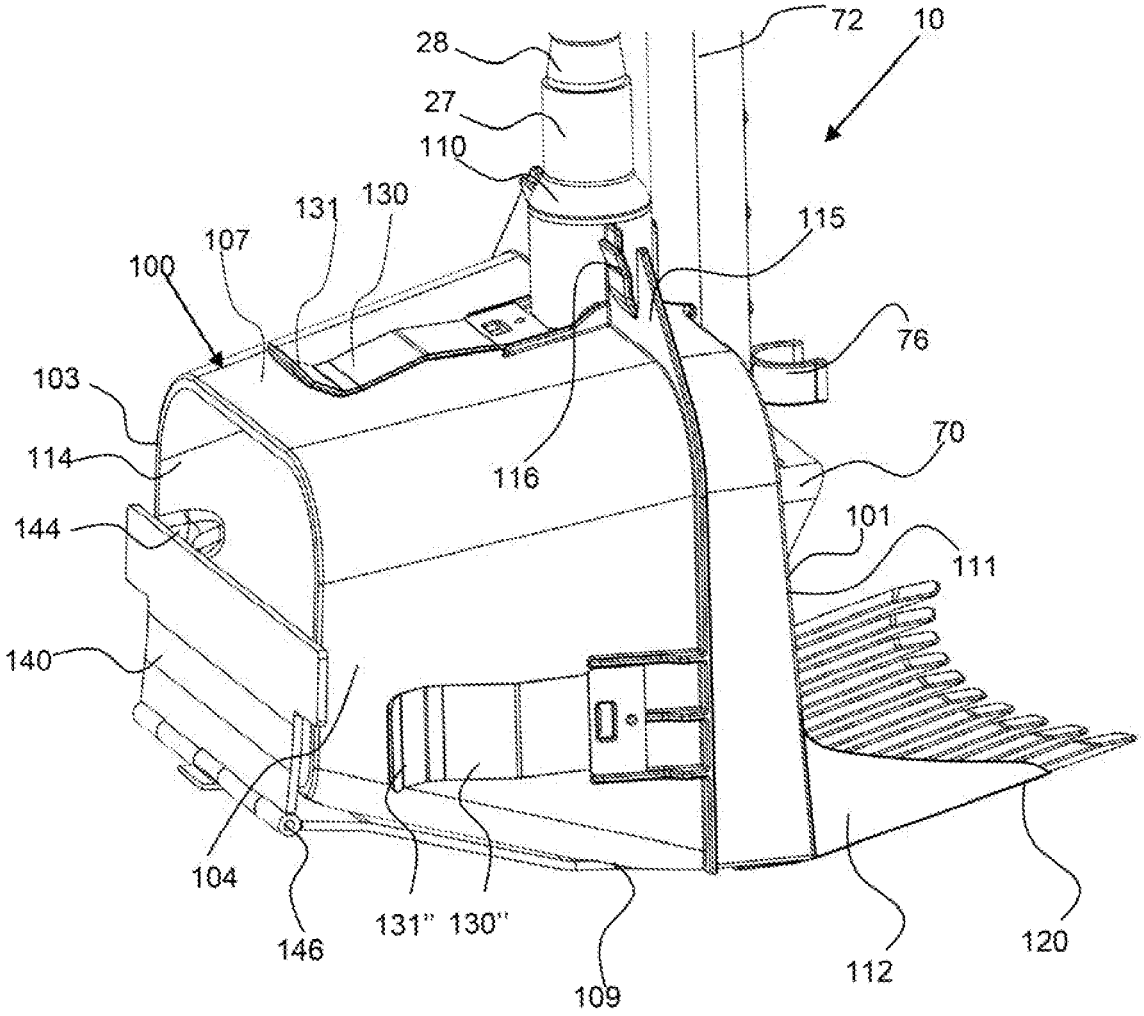
FIG. 15 shows a back perspective view of an exemplary container of a scooper assembly.

Feces may be raked into the container by sliding the container such that the teeth 120 extend under the feces and direct the feces into the container. In an alternate method, the rake 70 may be used to rake the feces into the container. Also, as shown in FIGS. 13 and 14, the rake may be coupled over the inlet opening of the container by the rake slot 78 and the rake connector 117, a protrusion on the container, for example. This prevents the feces from contacting the back of the container and/or the door 140. The rake 70 may be coupled over the inlet of the container when a receptacle for feces disposal such as a trash can is nearby. Clips 130 on the top and sides have flat flanges 131 for attaching waste bags. The smooth flange prevents bag damage.

Figure 16:
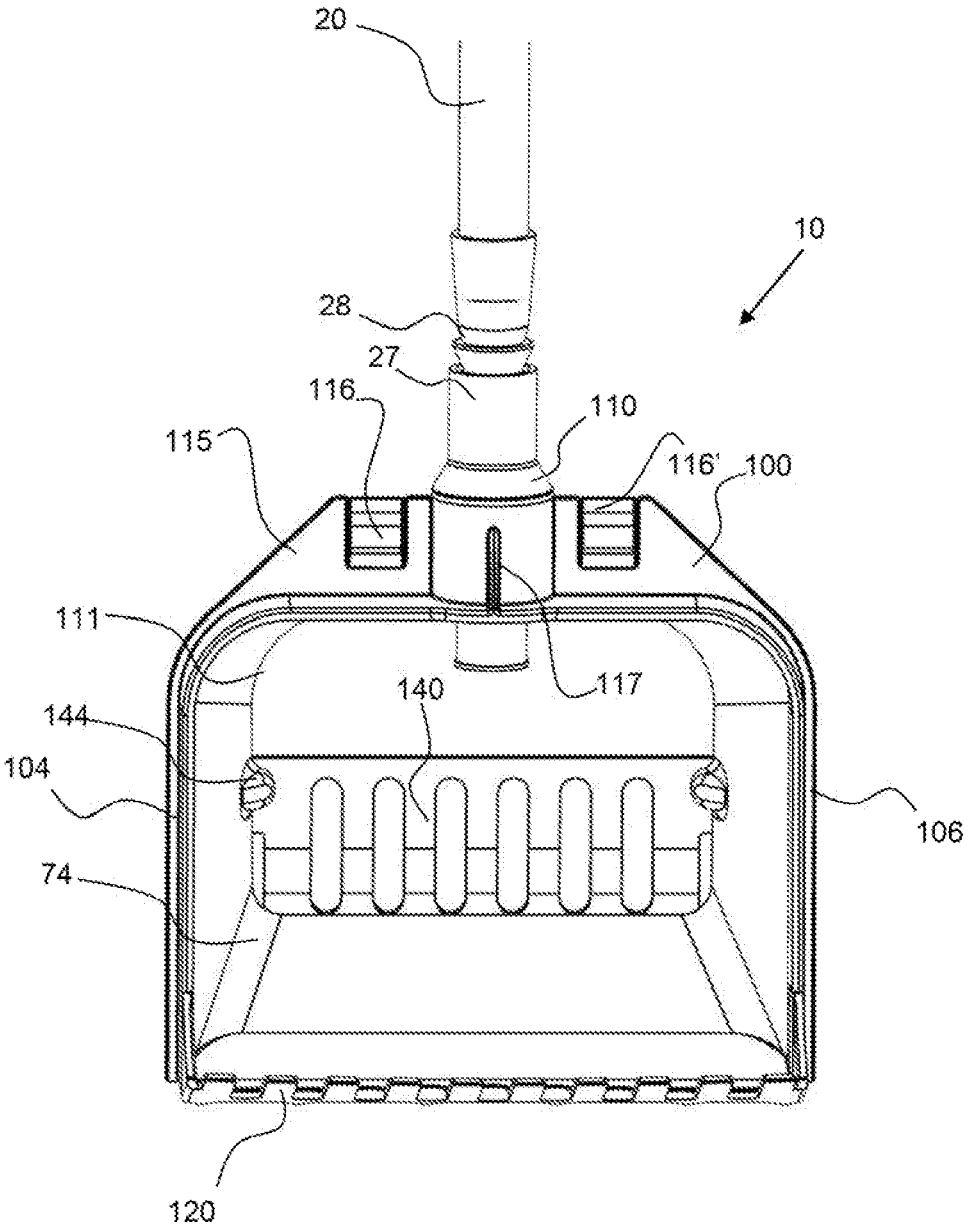
FIG. 16 shows a front view of an exemplary container of a scooper assembly.
Figure 17:
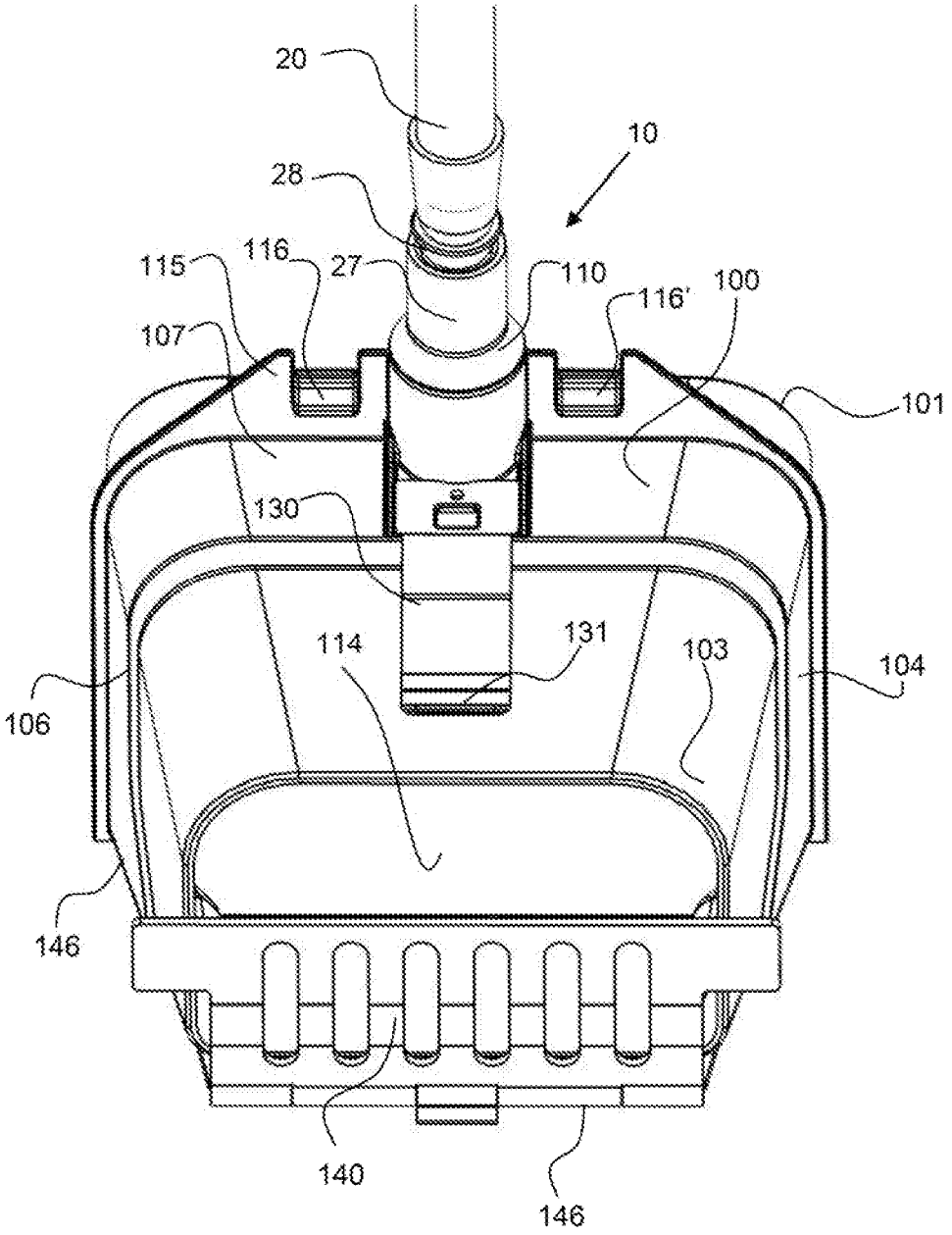
FIG. 17 shows a back view of an exemplary container of a scooper assembly with the back door in a closed position.
Figure 18:
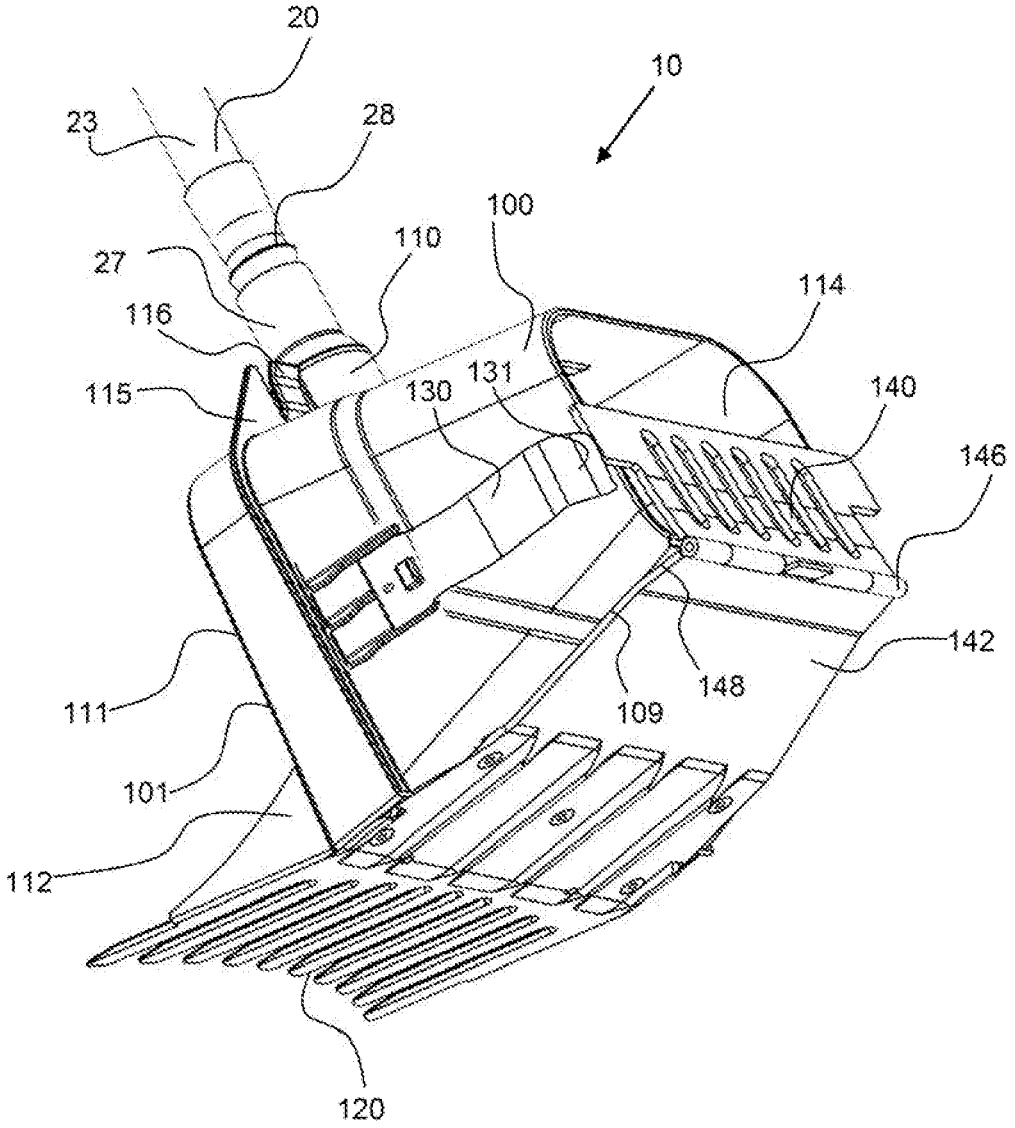
FIG. 18 shows a bottom perspective view of an exemplary container of a scooper assembly with the door in a closed position.

As shown in FIG. 18, the door connector 142 extends along the underside of the container and ends in the back at the door hinge 146 and creates a bag-slit 148 between the door connector and the bottom of the container 109. The bottom of the container 109 and the door connector 142 separate to create the bag-slit that ends as an opening just inside the door hinge 146. When the door is opened, a bag can be slid into the bag-slit 148 as far as it will go and then the opening of the waste-bag 12 can be fit around the outlet opening 114 of the container and under the clips 130 to secure the bag around the outlet opening of the container 110. The bag may extend under or around the clip flange 131 when attached. A small or large diameter bag may be retained under the clip 130 and a larger diameter bag may be retained around the clip flange 131, the portion of the clip that flares up. A bag may also be retained by the cleats 116 on the rib 115 as an alternate means to retain large bags or bags with handles during use. The door 140 is secured in a closed position by door clips 144 configured on the container 100, as shown in FIG. 16. The rib 115 extends to the bottom sides of the container to add strength to support a user's leaning weight.

Figure 19:
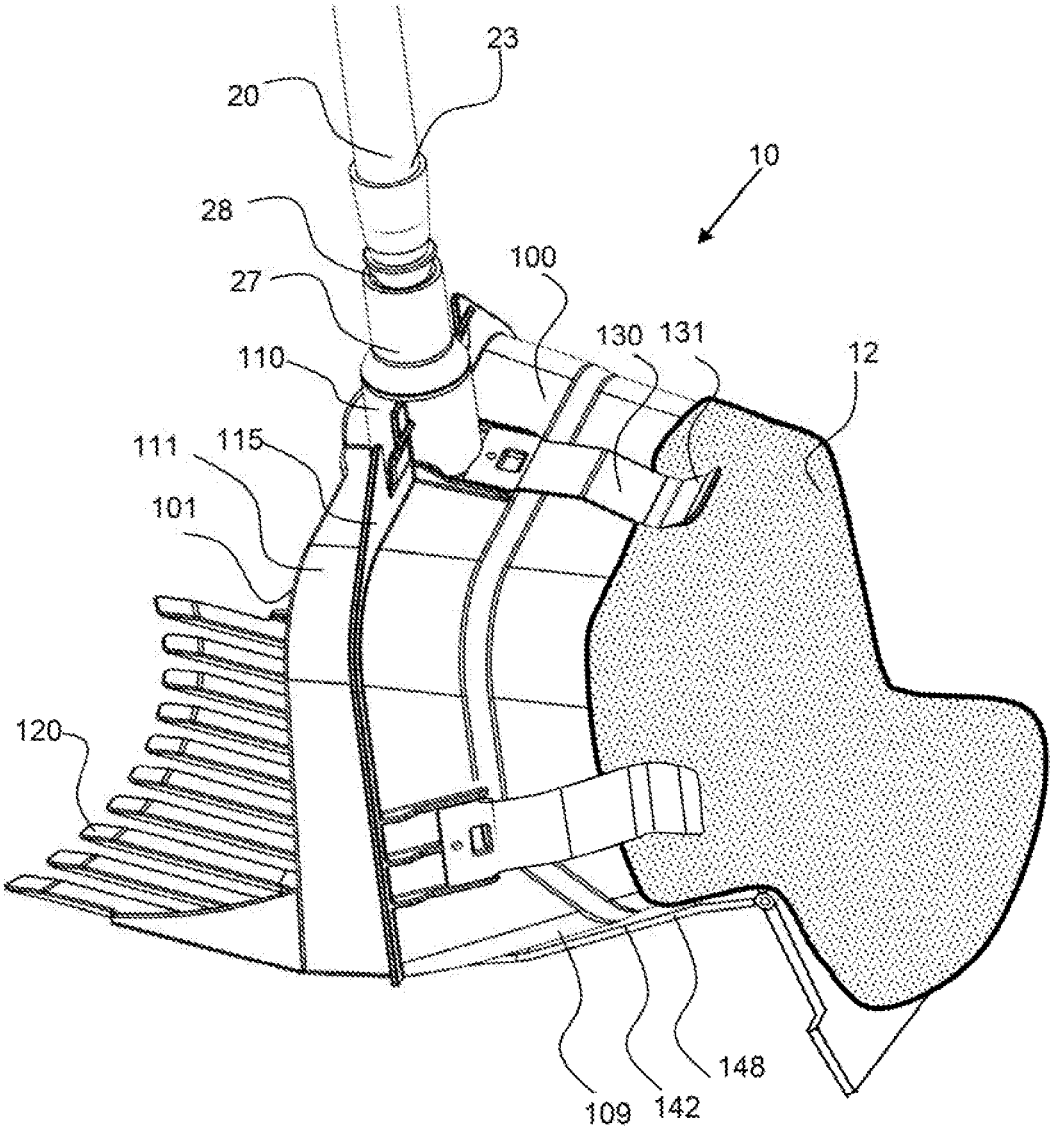
FIG. 19 shows a back-side perspective view of an exemplary container of a scooper assembly with the door in an open position and a bag configured around the back outlet opening of the container and under the clip and in the retainer slit between the door connector and the bottom of the container.
Figure 20:
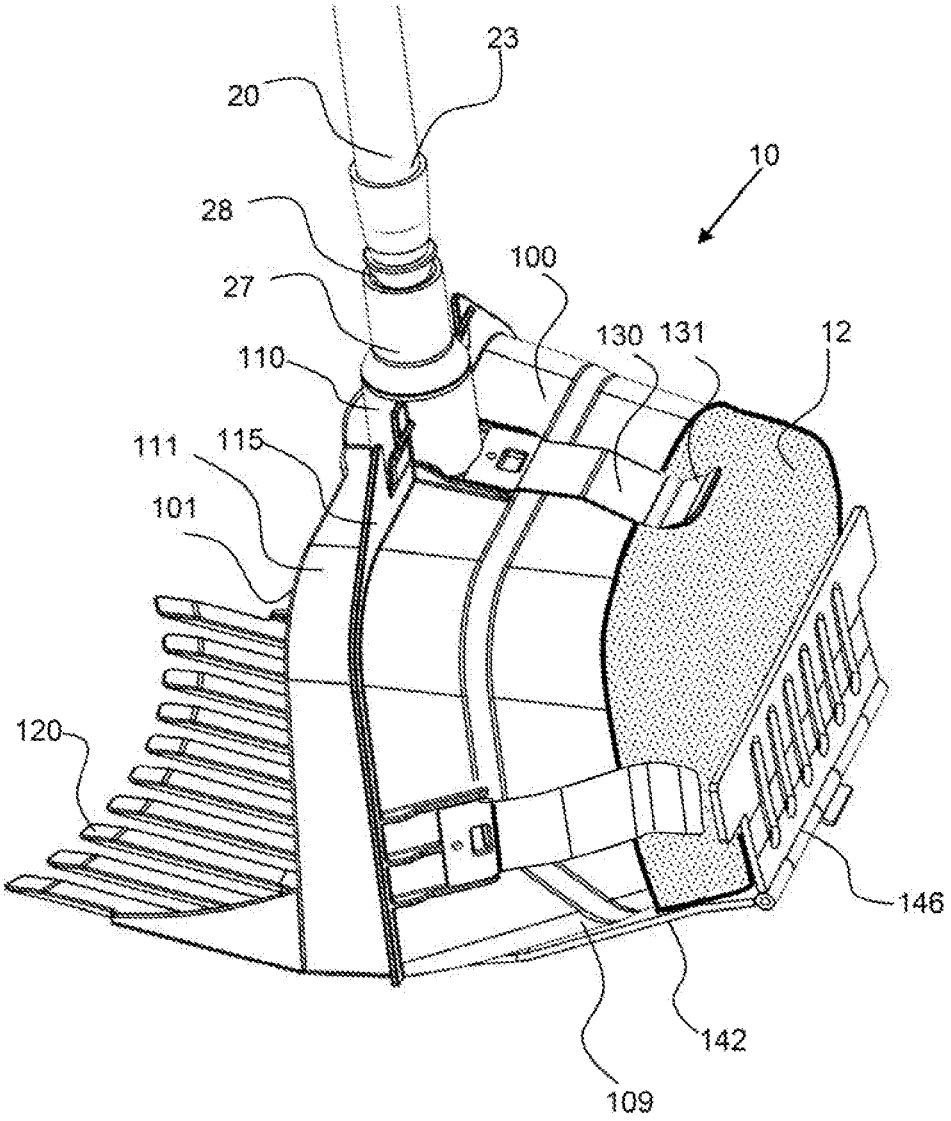
FIG. 20 shows the container as shown in FIG. 19 with the door in a closed position and the bag placed loosely inside the container.

A bag 12 may be coupled around the outlet opening 114 of the container by the one or more clips 130 as shown in FIGS. 19 and 20. The door 140 may be opened by the door hinge 146 as shown in FIG. 19 to enable the bag to be slid over the outlet opening, under the clip or clips and into the tapered slit or slot between the bottom of the container 109 and the door connector 142. The container is tapered toward the outlet opening to facilitate coupling a bag over the outlet opening. After the bag 12 is retained around the outlet opening, the bag is pushed into the container and sits loosely inside and then the door 140 may be closed as shown in FIG. 20. Closing the door with the bag inserted into the slit above the door connector 142 prevents fecal matter from contacting the outside of the bag as the container is moved along the ground to collect the feces.

After fecal matter is collected in the container, the door may be opened, and the container tipped to where the back of the container is facing downward so that the feces drops into the loose bag to fill it. The bag is subsequently removed from the container by the user's hand pulling the bag down and off of the container. With the bag inserted in the slit, the inside of the bag that is in the slit is protected from being soiled by fecal waste as the waste drops into the bag to remove it from the container. When the bag is tied off by a knot near the top of the bag, the inside of the bag above the knot should be clean so that there is no exposed waste during handling.

Figure 21:
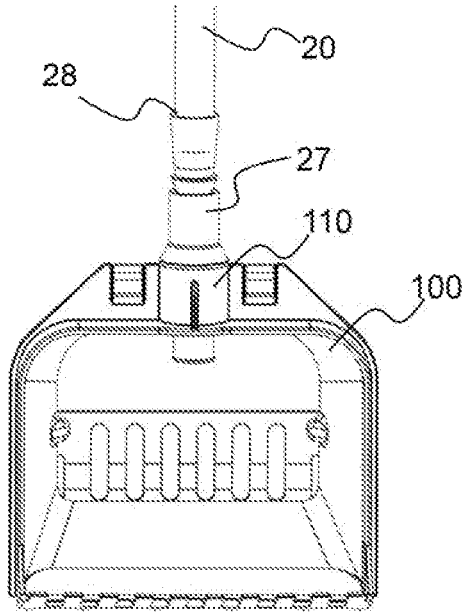
FIG. 21 shows a front perspective view of a hiking stick coupled to the container via an adapter.
Figure 22:
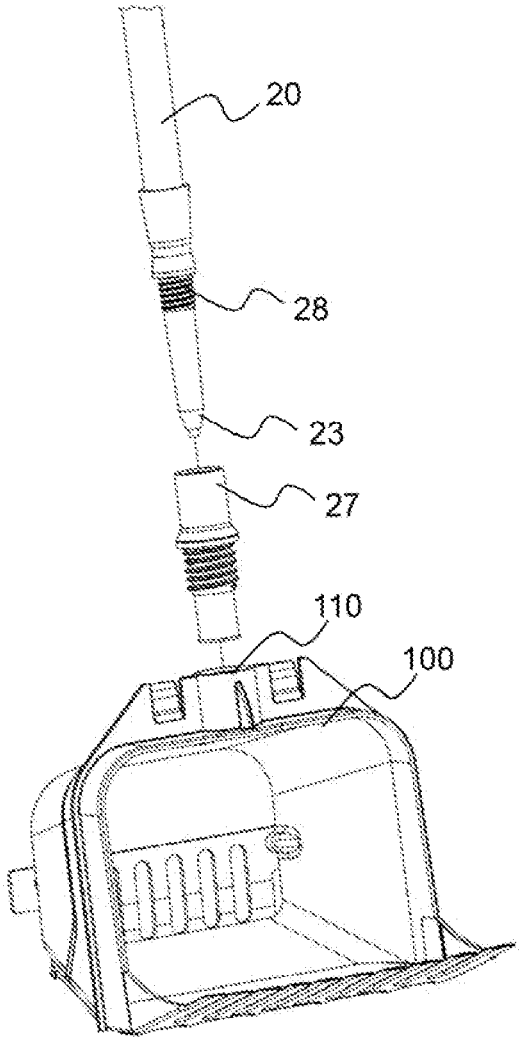
FIG. 22 shows an exploded view of the hiking stick, attachment feature of the hiking stick on the container end, an adapter, and a container attachment feature.
Figure 23:
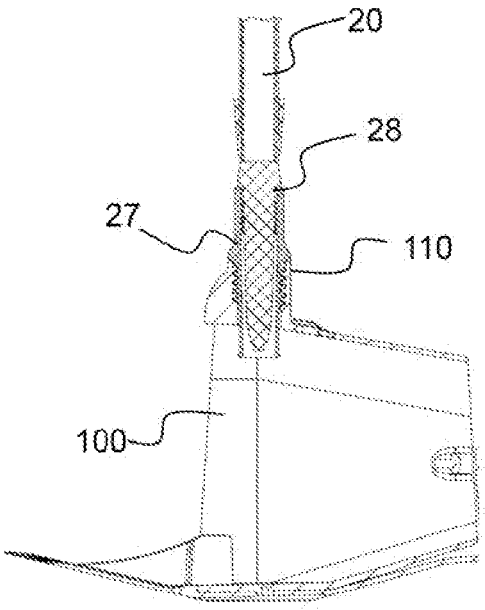
FIG. 23 shows a cross sectional view of the hiking stick, attachment feature of the hiking stick on the container end, an adapter, and a container attachment feature.

As shown in FIGS. 21 to 23, the shaft of the hiking stick 20 is coupled to the container 100 by an adapter 27 that is configured between the container attachment feature 110 and the hiking stick attachment feature 28 of the shaft, such as threads. The adapter comprises threads for engagement with threads on the hiking stick attachment feature 28 and with threads in the container attachment feature 110. The adapter enables the container to be coupled to a wide variety of shafts or hiking sticks and different adapters may be required with different threads for coupling to the different types of hiking sticks.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A scooper assembly for collecting feces comprising:
- a) a hiking stick having a length from a handle end to a container end;
- b) a handle configured on the handle end;
- c) a bag-retainer comprising:
  - i) a bag roll receiver;
  - ii) a bag-slot in the bag roll receiver to allow an extended end of a roll of bags to pass therethrough; and
  - iii) a cleat comprising two vertical slots for receiving and retaining a filled bag that has feces collected therein.

2. The scooper assembly of claim 1, wherein the bag-retainer is detachably attachable to the hiking stick and comprises a bag-clip that extends at least partially around the hiking stick.

3. The scooper assembly of claim 1, wherein the bag-retainer further comprises bag-teeth configured on a vertical arm to engage with perforations in the roll of bags to separate a bag from the roll of bags.

4. The scooper assembly of claim 1, further comprising a filled bag tray for receiving and retaining said filled bag, and wherein the filled bag tray is configured under the bag-retainer and cleat, whereby a filled end of the filled bag is configured for retention in the filled bag tray and a tied end of the filled bag is configured for retention in the cleat.

5. The scooper assembly of claim 1, further comprising a receptacle attached to the hiking stick.

6. The scooper assembly of claim 5, wherein the receptacle is detachably attached to the hiking stick by a receptacle-clip.

7. The scooper assembly of claim 1, further comprising a light-mount attached to the hiking stick and comprising:
- a) an insert end;
- b) a protrusion end;
- c) a plurality of leaves tapering down toward the protrusion end and configured to expand outward when a light is inserted therethrough;
- d) a light pivot configured between the light-mount and the hiking stick that allows for 360-degree rotation of the light-mount.

8. The scooper assembly of claim 7, wherein the light-mount is detachably attached to the hiking stick by a light-mount clip, wherein the light pivot is configured between said light-mount clip and the light-mount.

9. A scooper assembly for collecting feces comprising:
- a) a hiking stick having a length from a handle end to a container end;
- b) a handle configured on the handle end;
- c) a bag-retainer comprising:
  - i) a bag roll receiver;
  - ii) a bag-slot in the bag roll receiver to allow an extended end of a roll of bags to pass therethrough; and
  - iii) a bag core interface extending from the bag roll receiver for receiving and retaining said roll of bags
- d) a container coupled to the container end of the hiking stick and comprising:
  - iv) an interior for receiving and retaining feces;
  - v) a front having an inlet opening for receiving said feces therethrough;
  - vi) a plurality of teeth extending from the front of the container;
  - vii) a back having an outlet opening for disposing feces from the container interior;
  - viii) a plurality of clips including a clip on a top, a clip on a left side and a clip on a right side of the container;

wherein the container is configured to retain a bag by the plurality of clips with an opening of the bag extended around the outlet opening of the container to receive said feces collected in the container.

10. The scooper assembly of claim 9, further comprising a door coupled to the back of the container and comprising a pivot to enable said door to pivot from a closed position, wherein it covers at least a portion of the outlet opening to an open position to allow said feces collected in the container to be dumped through the outlet opening.

11. The scooper assembly of claim 9, wherein the container is detachably attached to the hiking stick by a threaded attachment feature.

12. The scooper assembly of claim 9, wherein the plurality of clips comprises a clip flange that extends outward from the container body to retain a bag thereover.

13. The scooper assembly of claim 9, wherein the plurality of teeth have extended ends that form a concave shape.

14. The scooper assembly of claim 13, wherein the plurality of teeth extend up from the bottom of the container at an incline angle of at least 5 degrees.

15. The scooper assembly of claim 9, further comprising a rake detachably attached to the hiking stick by a rake retainer clip.

* * * * *